US009453380B2

(12) United States Patent
Hardin, Jr. et al.

(10) Patent No.: US 9,453,380 B2
(45) Date of Patent: Sep. 27, 2016

(54) REMOTE HYDRAULIC CONTROL OF DOWNHOLE TOOLS

(71) Applicant: Halliburton Energy Services, Inc., Houston, TX (US)

(72) Inventors: John Ransford Hardin, Jr., Spring, TX (US); Daniel M. Winslow, Spring, TX (US); Jean-Pierre Lassoie, Anderlecht (BE); Nicolas Mouraret, Ixelles (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/375,751

(22) PCT Filed: Feb. 26, 2013

(86) PCT No.: PCT/US2013/027825
§ 371 (c)(1),
(2) Date: Jul. 30, 2014

(87) PCT Pub. No.: WO2014/133487
PCT Pub. Date: Sep. 4, 2014

(65) Prior Publication Data

US 2015/0292281 A1 Oct. 15, 2015

(51) Int. Cl.

| | |
|---|---|
| ***E21B 21/10*** | (2006.01) |
| ***E21B 34/10*** | (2006.01) |
| ***E21B 10/32*** | (2006.01) |
| ***E21B 21/08*** | (2006.01) |

(52) U.S. Cl.
CPC ..... *E21B 21/103* (2013.01); *E21B 10/322* (2013.01); *E21B 21/08* (2013.01); *E21B 34/102* (2013.01); *E21B 34/108* (2013.01)

(58) Field of Classification Search
CPC .... E21B 21/103; E21B 10/322; E21B 21/08; E21B 21/10; E21B 34/102; E21B 34/108
See application file for complete search history.

(56) References Cited

U.S. PATENT DOCUMENTS 6,161,632 A 12/2000 Hovden et al.
6,173,795 B1 * 1/2001 McGarian ..... E21B 21/10 166/321

(Continued)

FOREIGN PATENT DOCUMENTS

EP 0220401 A2 5/1987
WO WO-2011/146836 A2 11/2011

(Continued)

OTHER PUBLICATIONS

"International Application Serial No. PCT/US2013/027825, International Search Report mailed Nov. 11, 2013", 3 pgs.

(Continued)

*Primary Examiner* — Brad Harcourt
(74) *Attorney, Agent, or Firm* — Schwegman, Lundberg & Woessner, P.A.; Alan Bryson

(57) ABSTRACT

A well tool apparatus comprises a control arrangement configured to control response of the downhole tool by varying a bore-annulus pressure difference. The control arrangement includes a valve piston longitudinally slidable in a generally tubular controller housing that is in operation substantially co-axial with the wellbore, to open or close a valve port to a fluid flow connection between the drill string's interior and the tool. A latch mechanism is configured to latch the valve piston against movement in one axial direction, keeping the valve piston in an open or a closed condition. Unlatching of the valve piston requires displacement thereof in the other axial direction to a mode change position. A stay member is automatically displaceable under hydraulic actuation responsive to bore-annulus pressure differences above a trigger threshold value, to obstruct movement of the latched valve piston under hydraulic actuation to the mode change position.

19 Claims, 15 Drawing Sheets

(56) References Cited

U.S. PATENT DOCUMENTS

| | | | | |
|---|---|---|---|---|
| 6,557,332 | B2 | 5/2003 | Rhody | |
| 6,708,785 | B1 | 3/2004 | Russell et al. | |
| 2002/0014338 | A1 | 2/2002 | Purkis et al. | |
| 2004/0222022 | A1 | 11/2004 | Nevlud et al. | |
| 2005/0241858 | A1 | 11/2005 | Eppink et al. | |
| 2009/0032308 | A1 | 2/2009 | Eddison et al. | |
| 2009/0090501 | A1 | 4/2009 | Hansen et al. | |
| 2009/0126936 | A1 | 5/2009 | Begley et al. | |
| 2010/0300702 | A1 | 12/2010 | Andrews et al. | |
| 2011/0030963 | A1 | 2/2011 | Demong et al. | |
| 2011/0127044 | A1* | 6/2011 | Radford | E21B 10/322 166/373 |
| 2012/0199363 | A1 | 8/2012 | Hu | |

FOREIGN PATENT DOCUMENTS

| | | | |
|---|---|---|---|
| WO | WO-2014/133487 | A2 | 9/2014 |
| WO | WO-2014/133487 | A3 | 9/2014 |

OTHER PUBLICATIONS

"International Application Serial No. PCT/US2013/027825, Written Opinion mailed Nov. 11, 2013", 5 pgs.
"International Application Serial No. PCT/US2013/027825, International Preliminary Report on Patentability mailed Sep. 11, 2015", 7 pgs.
"International Application Serial No. PCT/US2015/022311, International Search Report mailed Dec. 2, 2015", 4 pgs.
"International Application Serial No. PCT/US2015/022311, Written Opinion mailed Dec. 2, 2015", 4 pgs.
"International Application Serial No. PCT/US2015/025990, International Search Report mailed Dec. 10, 2015", 3 pgs.
"International Application Serial No. PCT/US2015/025990, Written Opinion mailed Dec. 10, 2015", 5 pgs.
"Chinese Application Serial No. 201380063968.2, Office Action mailed Feb. 14, 2016", W/English Translation, 11 pgs.
"Canadian Application Serial No. 2,898,170, Office Action mailed Jun. 7, 2016", 4 pgs.

* cited by examiner

REMOTE HYDRAULIC CONTROL OF DOWNHOLE TOOLS

PRIORITY APPLICATION

This application is a U.S. National Stage Filing under 35 U.S.C. 371 from International Application No. PCT/US2013/027825, filed on 26 Feb. 2013; the application is incorporated herein by reference in its entirety.

TECHNICAL FIELD

The present application relates generally to downhole tools in drilling operations, and to methods of operating downhole tools. Some embodiments relate more particularly to fluid-activated control systems, mechanisms and methods for downhole tools. The disclosure also relates to downhole reamer deployment control by fluid-pressure sequencing.

BACKGROUND

Boreholes for hydrocarbon (oil and gas) production, as well as for other purposes, are usually drilled with a drill string that includes a tubular member (also referred to as a drilling tubular) having a drilling assembly which includes a drill bit attached to the bottom end thereof. The drill bit is rotated to shear or disintegrate material of the rock formation to drill the wellbore. The drill string often includes tools or other devices that require remote activation and deactivation during drilling operations. Such tools and devices include, among other things, reamers, stabilizers or force application members used for steering the drill bit.

Electro-mechanical control systems are often unreliable in such drilling environments. Remote control of downhole tool activation by controlling fluid pressure in the drill string often allow only a single activation/deactivation cycle, after which the control system is to be reset, while reduction in effective drill string diameter result in some systems. Utilization of the drilling fluid (e.g., mud cycled down the drill string and back up a borehole annulus) introduce the risk of inadvertent tool activation during normal drilling operations.

BRIEF DESCRIPTION OF THE DRAWINGS

Some embodiments are illustrated by way of example and not limitation in the figures of the accompanying drawings in which.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Figure 1:
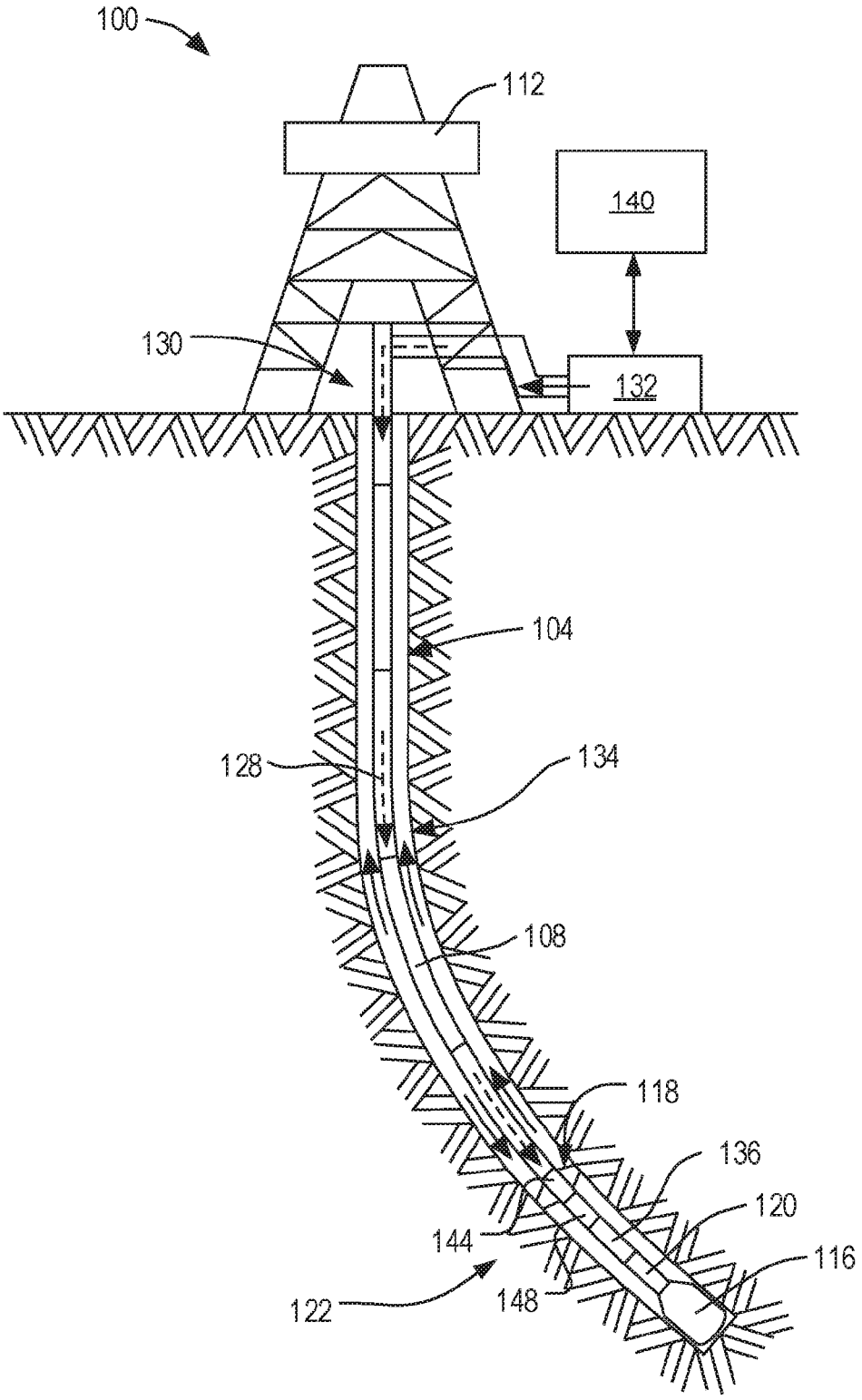
FIG. 1 depicts a schematic diagram of a drilling installation that includes a drilling apparatus that provides a control arrangement for remote fluid-activated control of tool activation, in accordance with an example embodiment.

FIG. 1 is a schematic view of an example embodiment of a system to control downhole tool operation with fluid-pressure. A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 122 at a bottom end of the drill string 108 may include a drill bit 116 to disintegrate earth formations at a leading end of the drill string 108, to pilot the borehole 104, and one or more reamer assemblies 118, uphole of the drill bit 116 to widen the borehole 104 by operation of selectively expandable cutting elements.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the centerline of the cylindrical borehole 104. "Axial" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" means a substantially arcuate or circular path described by rotation of a tangential vector about the borehole axis.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and to towards the earth's surface.

A measurement and control assembly 120 may be included in the BHA 122, which also includes measurement instruments to measure borehole parameters, drilling performance, and the like.

Drilling fluid (e.g. drilling "mud," or other fluids that may be in the well), is circulated from a drilling fluid reservoir 132, for example a storage pit, at the earth's surface, and coupled to the wellhead, indicated generally at 130, by means of a pump (not shown) that forces the drilling fluid down a drilling bore 128 provided by a hollow interior of the drill string 108, so that the drilling fluid exits under high pressure through the drill bit 116. After exiting from the drill string 108, the drilling fluid occupies a borehole annulus 134 defined between the drill string 108 and a wall of the borehole 104. Although many other annular spaces may be associated with the system 102, references to annular pressure, annular clearance, and the like, refer to features of the borehole annulus 134, unless otherwise specified.

Note that the drilling fluid is pumped along the inner diameter (i.e., the bore 128) of the drill string 108, with fluid flow out of the bore 128 being restricted at the drill bit 116.

The drilling fluid then flows upwards along the annulus 134, carrying cuttings from the bottom of the borehole 104 to the wellhead 130, where the cuttings are removed and the drilling fluid may be returned to the drilling fluid reservoir 132. Fluid pressure in the bore 128 is therefore greater than fluid pressure in the annulus 134. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. In this example embodiment, a downhole motor 136 (such as, for example, a so-called mud motor or turbine motor) disposed in the drill string 108 and, this instance, forming part of the BHA 122, may rotate the drill bit 116. In some embodiments, the rotation of the drill string 108 may be selectively powered by one or both of surface equipment and the downhole motor.

The system 102 may include a surface control system 140 to receive signals from sensors and devices incorporated in the drill string 108 (typically forming part of the BHA 122). The surface control system 140 may display drilling parameters and other information on a display or monitor that is used by an operator to control the drilling operations. Some drilling installations may be partly or fully automated, so that drilling control operations (e.g., control of operating parameters of the motor 136 and control of downhole tool deployment through pressure sequencing of the drilling fluid, as described herein) may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of downhole tools and devices that are downhole and/or surface devices.

The drill string 108 may include one or more downhole tools instead of or in addition to the reamer assemblies 118 mentioned previously. The downhole tools of the drill string 108, in this example, thus includes at least one reamer assembly 118 located in the BHA 122 to enlarge the diameter of the borehole 104 as the BHA 122 penetrates the formation. In other embodiments, a reamer assembly 118 may be positioned uphole of and coupled to the BHA 122. Each reamer assembly 118 may comprise one or more circumferentially spaced blades or other cutting elements that carry cutting structures. The reamer assembly 118 houses a reamer 144 that is selectively extended and retracted radially from a housing of the reamer assembly 118, to selectively increase and decrease in diameter.

In this embodiment, the reamer 144 is hydraulically actuated by use of the pressurized drilling fluid. The pressurized drilling fluid is also used to select a deployment mode of the reamer 144. In this example, deployment control mechanisms to achieve such fluid-pressure control of the reamer 144 are provided by a controller 148 that comprises an assembly having a drill-pipe body or housing 215 (see FIG. 2) connected in-line in the drill string 108. In this embodiment, the controller 148 is mounted downhole of the associated reamer assembly 118.

Fluid Pressure Considerations

Note that, despite the benefits fluid-pressure control of tool deployment (which will be discussed presently), such fluid-pressure control may introduce difficulties in performing drilling operations. There is seldom, for example, a simple direct correspondence between fluid pressure values and desired reamer deployment. Although reaming operations in this example coincide with high fluid pressure in the bore 128 (also referred to as bore pressure or internal pressure), the reamer 144 is not to be deployed with every occurrence of high bore pressure.

The bore pressure may, for example be ramped up to drive the drill bit 116 via the motor 136 when the borehole 104 is being drilled. Reamer deployment during such a drilling phase is often to be avoided.

A function of the controller 148, in this embodiment, is to selectively adjust the way in which the reamer 144 responds to certain fluid pressure conditions. The reamer assembly 118 may be bi-modal, selectively being disposed in either a dormant mode or an active mode. In the dormant mode, the reamer 144 is retracted and remains retracted regardless of high bore pressures (e.g., pressures at operating levels for downhole machine such as the motor 136). In the active mode, the reamer 144 is dynamically responsive to bore pressure, so that high bore pressures automatically and invariably result in deployment of the reamer 144 by radial extension of the reamer 144's cutting elements. Control of the reamer assembly 118 to selectively disclose it to one of the modes or the other may be by producing a predefined sequence of bore pressure values. In an example, mode switching comprises application of a low pressure (relative to tool operating pressures) for longer than a predefined trigger time. Much of the description that follows discusses mechanisms to implement such pressure-sequence mode control of the reamer assembly 118.

Overview of Controller Operation

Figure 2A:
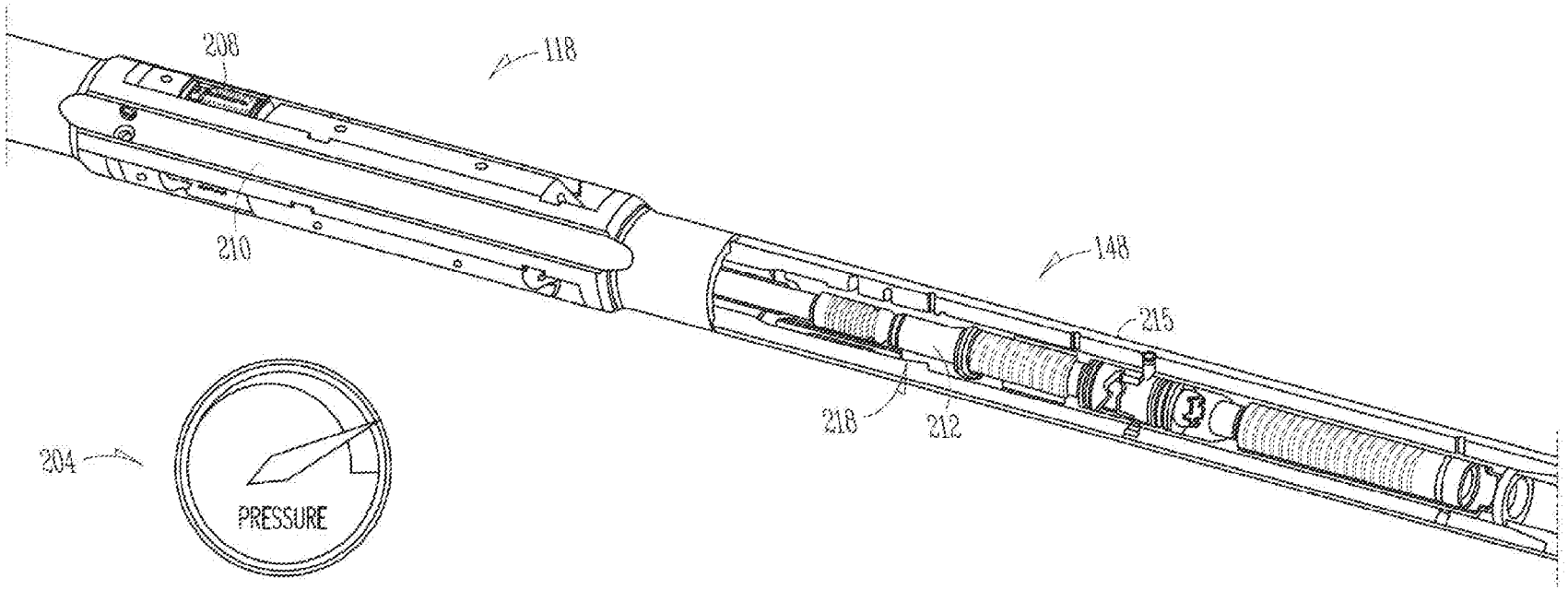
FIGS. 2A-2B depict partially sectioned three-dimensional views of a drilling apparatus for remote fluid-activated control of tool activation, in accordance with an example embodiment, an example tool in the form of a reamer being deployed in FIG. 2A and being retracted in FIG. 2B.

FIG. 2A shows the reamer assembly 118 in the dormant mode. As indicated by schematic pressure gauge 204, the drill string 108 has a high bore pressure, in this example corresponding to an operational pressure of the reamer assembly 118. "Operational pressure" here means pressure at or greater than bore pressures at which the relevant tool is to perform its primary function, in the case of the reamer assembly 118 being bore pressures during reaming.

Despite such operational pressure levels, the reamer 144 in FIG. 2A is in a retracted condition, in which reamer cutting elements in the example form of reamer arms 208 are retracted into a tubular reamer body 210. The reamer arms 208 do not project beyond a radially outer surface of the reamer body 210, and therefore do not engage the wall of the borehole 104.

Figure 2B:
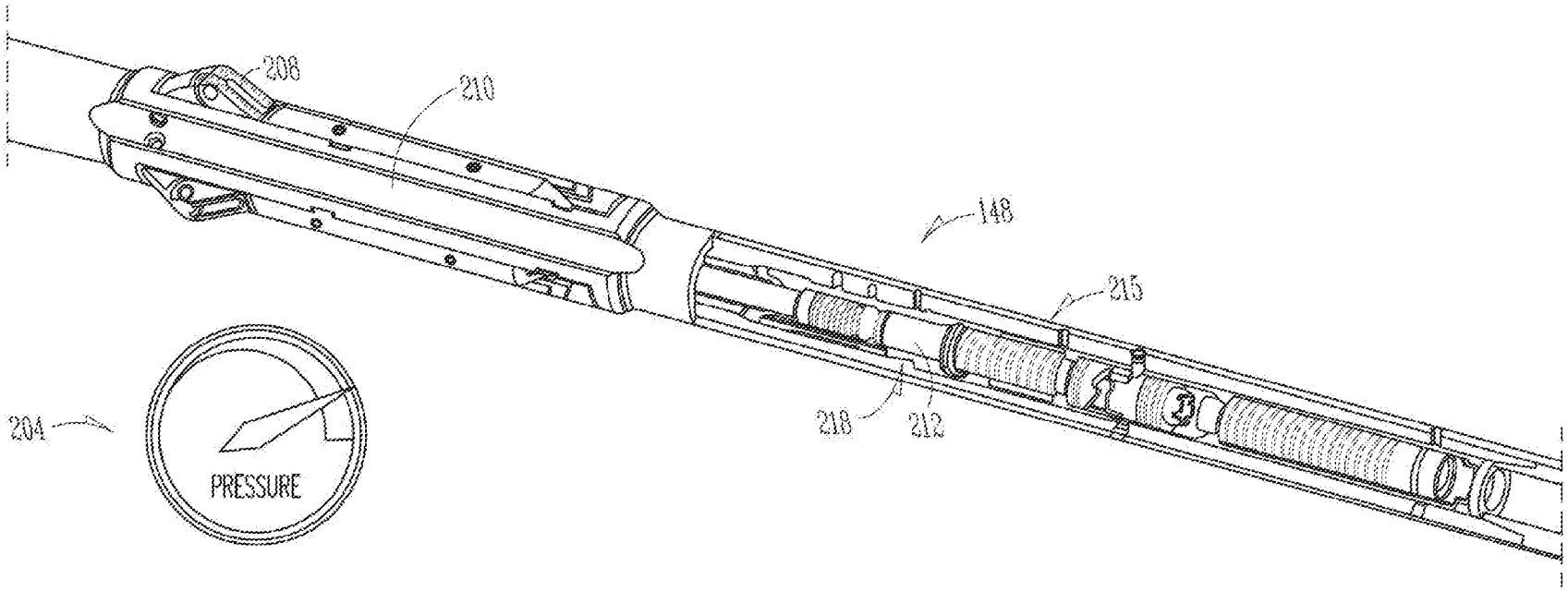

In FIG. 2B, however, the bore pressure is again at operational levels, but now the reamer 144 is in a deployed condition in which the reamer arms 208 are radially extended, standing proud of the reamer body 210 and projecting radially outwards from the reamer body 210 to make contact with the borehole wall for reaming of the borehole 104 when the reamer body 210 rotates with the drill string 108. In this example, the reamer arms 208 are mounted on the reamer body 210 in axially aligned, hingedly connected pairs that jackknife into deployment, when actuated.

The difference in functionality of the reamer assembly 118 and controller 148 between the dormant mode of FIG. 2A and the active mode of FIG. 2B is due to the respective axial positions of a valve closure member in the example form of a valve piston 212 within a controller housing 215 having a generally tubular wall 423 (FIG. 4). The controller 148 provides a valve port 218 to place the bore 128 in fluid flow communication with the reamer assembly 118. Exposure of the reamer assembly 118 to operational bore pressures, via the valve port 218, allows hydraulic actuation of the reamer arms 208 towards their deployed position. In the dormant mode (FIG. 2A) the valve piston 212 is axially positioned such that it closes the valve port 218, thus isolating the reamer assembly 118 from bore pressure and rendering it unresponsive to high bore pressure values. In the active mode, the valve piston 212 is positioned axially further downhole in the controller housing 215 relative to its position in the dormant mode, so that the valve piston 212 is clear of the valve port 218, exposing the reamer assembly 118 to bore pressure fluctuations and allowing automatic reamer deployment responsive to operational fluid pressure in the bore 128.

Axial displacement of the valve piston 212 from its dormant mode position to its active mode position, and vice versa, is by application of a trigger pressure condition that includes application of a pressure differential lower than a pre-defined trigger threshold value (in this example being about 20 bar) for at least a trigger threshold interval (in this example being about 15 minutes). Higher threshold intervals may reduce inadvertent activation risks, but some operators may prefer shorter threshold intervals, and these intervals may thus be varied depending on drilling conditions and/or user preference. In some embodiments, the trigger threshold interval may be about one minute.

Various hydro-mechanical aspects and features of the controller 148 will now be described, but note that the axial position of the valve piston 212, in this example embodiment, determines the operational mode of the reamer system provided by the reamer assembly 118 and controller 148. The mechanisms and components described hereafter cooperate to facilitate axial positioning of the valve piston 212 as desired by remote pressure-sequence control from the surface control system 140.

Some components and mechanisms of the controller 148 that contribute to such pressure-controlled reamer deployment will now briefly be mentioned in a high-level overview, after which these features are described at greater length in the context of this example embodiment. Thereafter, functional interaction of the example controller components is discussed.

High-Level Functional Overview

Figure 3A:
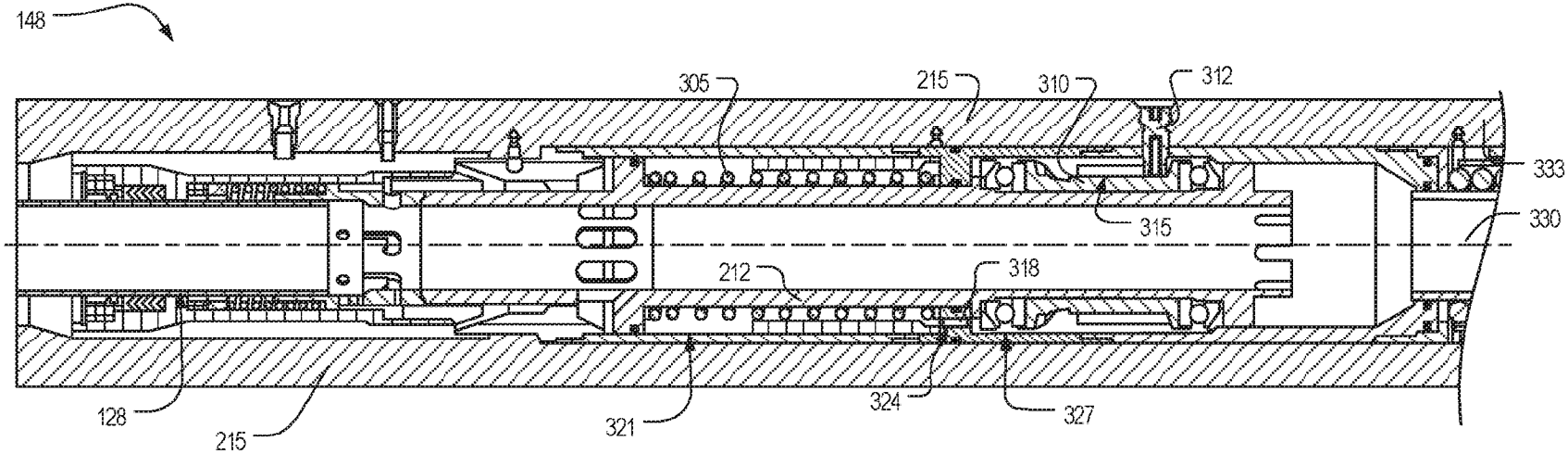
FIGS. 3A-3B depicts a longitudinal section of the drilling apparatus of FIG. 2, according to an example embodiment.
Figure 3B:
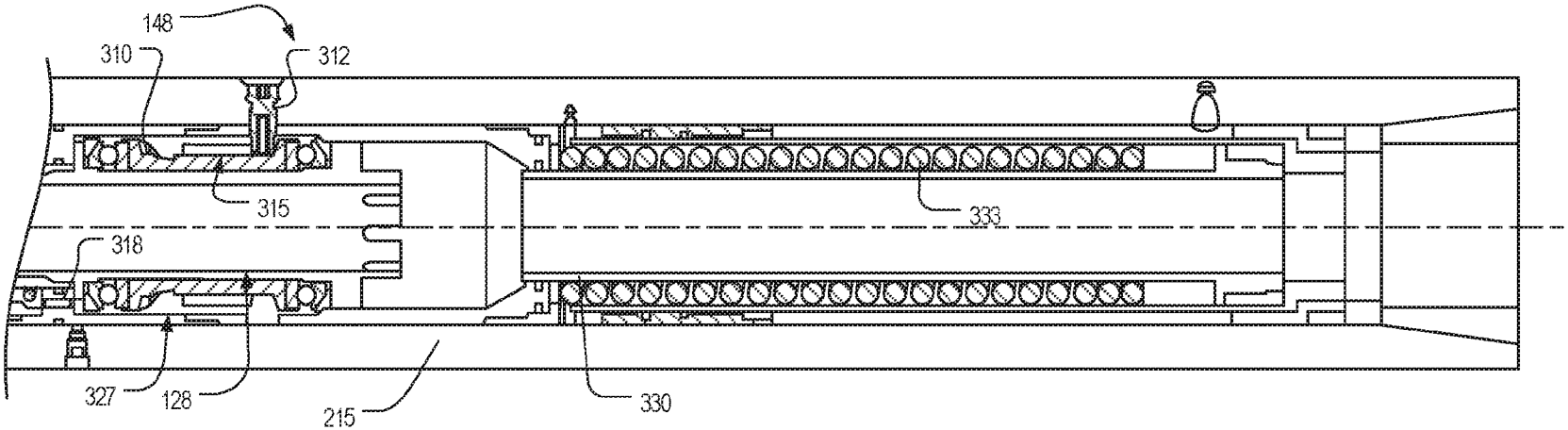

Numerous components acting directly and/or indirectly on the valve piston 212 to dispose it in either its dormant-mode position or its active-mode position can be seen in FIG. 3. The valve piston 212 is urged towards its dormant-mode position by a valve-closing bias arrangement in the example form of a closing spring 305 that acts between the controller housing 215 and the valve piston 212 to urge the valve piston 212 axially uphole, i.e. towards the left-hand side in FIG. 3. In the absence of hydraulic forces acting on the valve piston 212, the closing spring 305 would thus move the valve piston 212 uphole into a position where the valve port 218 is closed by a part of the valve piston 212 that acts as a valve closure member (see, e.g., valve closure sleeve 409 in FIG. 4). For clarity of illustration, the valve piston 212 is shown in the drawings to be of one-piece construction, but it may be comprised of two or more generally tubular members that are screwed together end-to-end, to facilitate assembly.

In the dormant mode, there is no obstruction to movement of the valve piston 212 into its closed position under the urging of the closing spring 305, absent fluid pressure. In the active mode, however, axial movement of the valve piston 212 towards the uphole end of the controller housing 215 (to close the valve port 218) is limited by a latch arrangement comprising a barrel cam 310 (which axially anchored to the valve piston 212 but is free to rotate about it) and a cooperating cam follower in the form of a latch pin 312 mounted on the controller housing 215. As will be described at greater length, the barrel cam 310 has a continuous recessed track 315 that is followed by the latch pin 312. The track 315 includes a latch slot 512 (FIG. 5) in which axial uphole movement of the valve piston 212 (to close the valve port 218) is stopped short of its valve-closing position by abutment of the latch pin 312 against a stopping end of the track 315's latch slot 512.

Switching to the active mode in this example thus comprises entry of the latch pin 312 into the latch slot 512 of the track 315 of the barrel cam 310, while switching to the dormant mode comprises escape of the latch pin 312 from the latch slot 512.

The valve piston 212 can move axially downhole within the controller housing 215, against the bias of the closing spring 305, when fluid pressure in the bore 128 is at operational levels ("high pressure/flow") or at a sub-operational levels ("low pressure/flow"). The speed of axial downhole movement of the valve piston 212 is limited by an opening speed control mechanism or retarding arrangement comprising a flow restrictor 318 that limits a rate of hydraulic flow through a flow control channel 324 from a control fluid reservoir 321 to a draw chamber 327. In this example, the flow restrictor 318 is a Lee Flosert that controls the rate at which oil can move through the flow control channel 324 from the control fluid reservoir 321 to the draw chamber 327 when there is a differential pressure across it. The effective flow rate through the flow restrictor 318 may thus be substantially constant for a range of pressure differences. Hence, the flow restrictor 318 controls the speed of movement of the valve piston 212, allowing accurate calculation of a trigger threshold interval for which the valve piston 212 is to move under hydraulic actuation in order to switch operational modes of the controller 148. The flow restrictor 318 may allow substantially unrestricted fluid movement in the opposite direction. Axial movement of the valve piston 212 downhole can also be blocked by a stay piston 330 mounted downhole of the valve piston 212 and urged axially downhole by a stay spring 333 to a rest position in which it is clear of interference with the valve piston 212. The stay piston 330 and its stay spring 333 are selected and arranged such that at high, operational mud pressure and/or flow, the stay piston 330 moves axially uphole, against the bias of the stay spring 333 (in an axial direction opposite to movement of the valve piston 212 under hydraulic drilling fluid actuation), to abut end-to-end against the valve piston 212, stopping further movement of the valve piston 212 axially downhole.

Due in part to operation of the flow restrictor 318, the stay piston 330 moves uphole faster than the valve piston 212 moves downhole, meeting and stopping the valve piston 212 before the latch pin 312 can escape or enter the latch slot 512 of the barrel cam 310, as the case may be. Thus, in the dormant mode, movement under operational pressure of the stay piston 330 blocks the valve piston 212 from advancing far enough downhole to clear the valve port 218 or allow the latch pin 312 to enter the latch slot 512 in the barrel cam 310. In the active mode fluid-pressure actuated uphole movement of the stay piston 330 blocks the valve piston 212 from advancing far enough downhole to exit the latch slot in the barrel cam 310, thus keeping the valve piston 212 latched in an axial range in which the valve port 218 is open.

These pistons and springs are, however, dimensioned and configured such that, at a sub-operational pressure lower than a threshold level (also referred to herein as a trigger pressure), the valve piston 212 is actuated to move axially downhole, overcoming elastic resistance of the closing spring 305, but a resultant hydraulic force on the stay piston 330 is not sufficient to overcome the stay spring 333. As a result, application of such a sub-operational or sub-threshold pressure for a period longer than a trigger interval causes axial downhole movement of the valve piston 212 (without obstruction by the now substantially stationary stay piston 330) far enough to allow entry of the latch pin 312 into the latch slot 512 (thus switching from the dormant mode to the active mode) or the allow the latch pin 312 to escape the latch slot (thus switching from the active mode to the dormant mode), as the case may be.

The controller components mentioned briefly above will now be described separately in more detail, whereafter cooperative behavior of the components of the example controller 148, in practice, are discussed.

Valve Piston Features

Figure 4A:
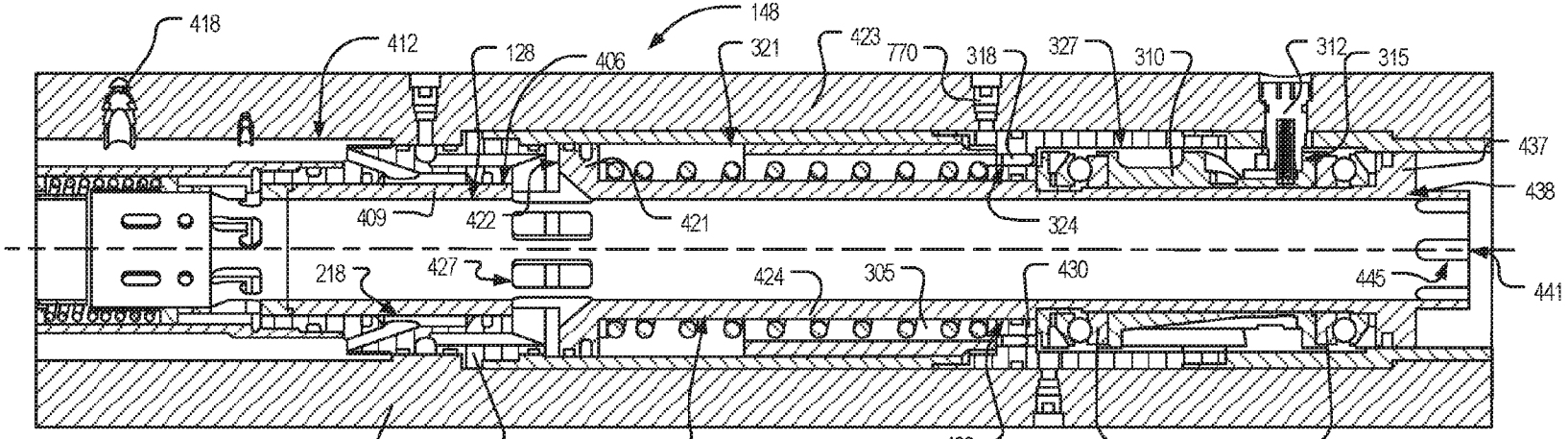
FIGS. 4A-4B depicts a longitudinal section of a part of the drilling apparatus of FIG. 2, on an enlarged scale, showing a valve piston of the drilling apparatus in an open condition and in a closed condition respectively.
Figure 4B:
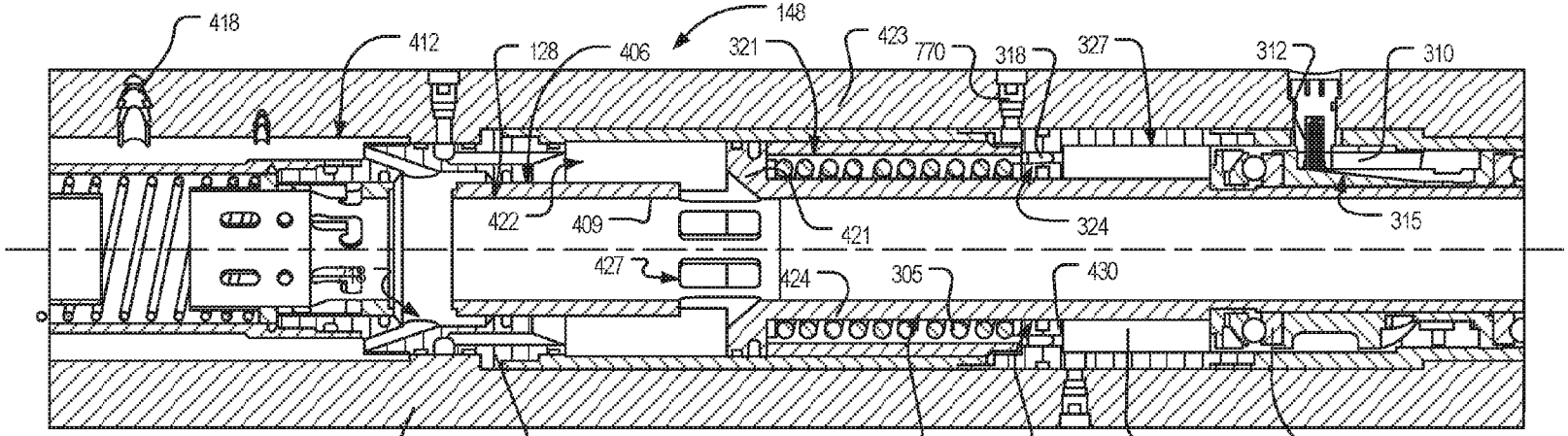

FIGS. 4A and 4B show views of the example controller 148 in the dormant and active modes respectively, in which some additional features of the example valve piston 212 are visible.

A valve port insert 404 is, in this example, mounted co-axially in the controller housing 215, defining a bore opening 406 in which a co-axial valve closure sleeve 409 provided by an uphole end portion of the valve piston 212 is sealingly received. The valve port insert 404 is anchored to the controller housing 215, with the valve closure sleeve 409 being axially slidable through the bore opening 406.

The valve port insert 404 defines the valve port 218 in the example form of a fluid flow channel that places a portion of the drill-string's bore 128 defined by the valve port insert 404 in communication with a substantially annular reamer actuation chamber 412. In its dormant mode position (FIG. 4A), the valve closure sleeve 409 closes the valve port 218, isolating the reamer actuation chamber 412 from the bore 128. When displaced axially downhole to its active-mode position (FIG. 4B), the uphole end of the valve piston 212 is clear of the valve port 218, so that the reamer actuation chamber 412 is in fluid flow communication with the bore 128 via the valve port 218, exposing the reamer actuation chamber 412 and therefore the reamer assembly 118 to bore pressure. The housing 215 includes one of more nozzles 418 to flush cuttings from the housing 215. Fluid ejection from the nozzles 418 may also as a surface pressure indicator to operators at the surface that tool activation has occurred. A relief valve (not shown) is provided between chamber 412 and the bore 128, serving as a failsafe measure in case the valve piston 212 the associated nozzles are clogged, trapping pressure below the drive piston. In such a case, the reamer arms can be forced down by pulling against a restriction hard enough to overcome the relief valve. Instead, or in addition, a relief valve may be provided between the chamber 412 and the annulus 134.

To the downhole side of the bore opening 406, the valve piston 212 has a radially projecting, circumferentially extending annular uphole collar or shoulder 421 that has a radially outer end edge in sealing, sliding engagement with an inner cylindrical surface of the controller housing 215's tubular wall 423. The valve piston 212 is thus co-axially slidable within the controller housing 215.

An annular space between a tubular central portion 424 of the valve piston 212 and the tubular wall 423 of the controller housing 215 provides, to a downhole side of the uphole shoulder 421, the control fluid reservoir 321.

The valve piston 212 has a circumferentially extending series of mud flow openings 427 positioned uphole of the shoulder 421, thus allowing fluid transfer between the bore 128 and an annular space extending radially between the cylindrical outer surface of the valve piston 212 and the tubular wall 423 of the controller housing 215, uphole of the uphole shoulder 421. Because fluid pressure in the control fluid reservoir 321 substantially matches annulus pressure (through operation of pressure balance mechanisms that will be discussed shortly), a pressure differential over the uphole shoulder 421 is substantial equal to the bore-annulus pressure differential. Typically, the higher of these pressures is on the uphole side of the uphole shoulder 421 (i.e., bore pressure), so that a net hydraulic force is exerted on the valve piston 212 in the downhole direction.

The controller housing 215 provides an annular chamber wall 430 that projects radially inwards from the controller housing's (215) tubular wall 423 at a position spaced downhole from the bore opening 406, axially beyond the uphole shoulder 421. The chamber wall 430 defines a cylindrical bore aperture 433 in which the valve piston 212 is slidingly received, a radially outer cylindrical surface of the valve piston 212 being in sealing engagement with a complementary mating radially inner edge surface of the chamber wall 430.

The chamber wall 430 thus sealingly bounds the control fluid reservoir 321 at an uphole end thereof. The chamber wall 430 is anchored against axial movement relative to controller housing 215. As a result, axial displacement of the valve piston 212 in the controller housing 215 changes the volume of the control fluid reservoir 321.

The closing spring 305 is located in the control fluid reservoir 321, being positioned co-axially about the central portion 424 of the valve piston 212 and acting between the uphole shoulder 421 and the chamber wall 430.

The valve piston 212 has a shoulder 437 adjacent its downhole end 441 analogous to the uphole shoulder 421, being annular and projecting radially to sealingly engage a radially inner cylindrical surface provided by the controller housing 215. The downhole shoulder 437 seals the draw chamber 327 at its downhole end. The draw chamber 327 is thus a substantially annular space defined radially between the valve piston 212 and a lining on the wall 423, and axially between the chamber wall 430 and the downhole shoulder 437. As mentioned, the draw chamber 327 is in fluid flow communication with the control fluid reservoir 321 via the flow control channel 324 having the flow restrictor 318.

Note that the draw chamber 327 is variable in volume responsive to axial displacement of the valve piston 212, increasing in volume upon downhole movement of the valve piston 212 (while the control fluid reservoir 321 decreases in volume), and vice versa.

The radially inner surface provided by the controller housing 215 is reduced at the downhole shoulder 437, when compared to the uphole shoulder 421, so that an axial end face 438 of the downhole shoulder 437 exposed in use to drilling fluid pressure in the bore 128 is smaller in area than an axial end face 422 of the uphole shoulder 421 exposed to substantially the same bore pressure. This difference facilitates downhole movement of the valve piston 212 responsive to differences between the bore pressure and the annular pressure.

The downhole end of the valve piston 212 defines a stub that projects axially beyond the downhole shoulder 437 and has a circumferentially extending series of holes 445. These holes 445 serve to permit radial fluid flow to and from the interior of the valve piston 212 even when the valve piston 212 is in end-to-end abutment with the stay piston 330.

Barrel Cam Features

As mentioned, the controller 148 according to this example embodiment includes a barrel cam 310 that is mounted co-axially in the valve piston 212. In the embodiment illustrated in FIG. 4, the barrel cam 310 is anchored to the valve piston 212 for axial movement therewith by being sandwiched by two axially spaced ball bearings 449 (FIG. 4) that are mounted for axial movement with the valve piston 212. By operation of the bearings 449, the barrel cam 310 is free to rotate relative to the valve piston 212 about the longitudinal axis.

Figure 5A:
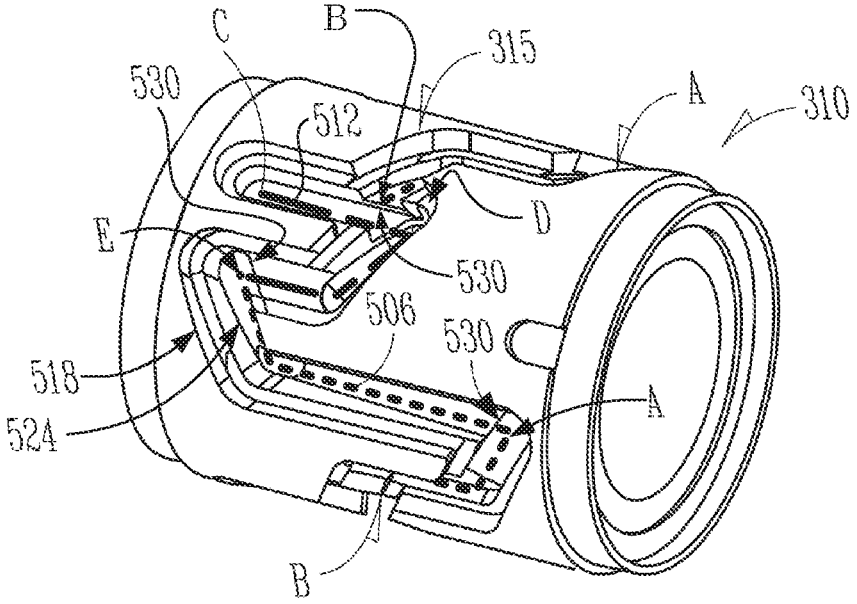
FIGS. 5A and 5B depict three-dimensional views of a barrel cam to form part of a drilling apparatus of FIG. 2, according to an example embodiment.
Figure 5B:
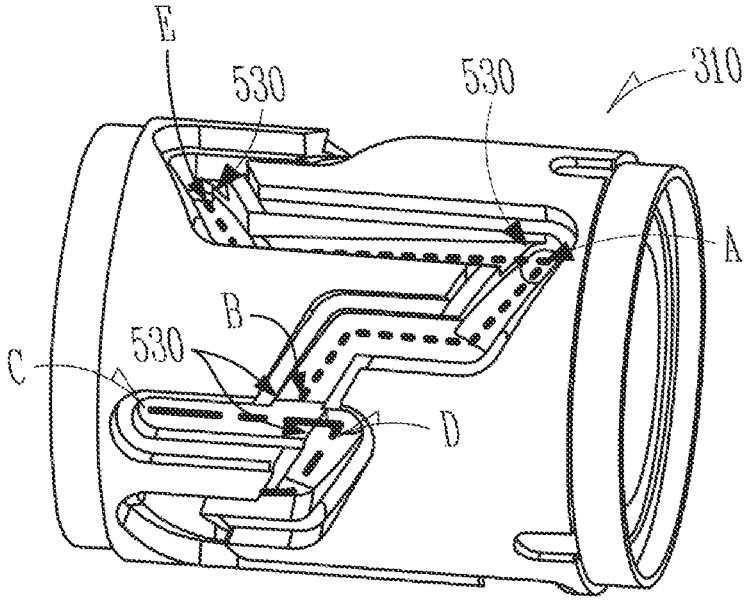
Figure 6:
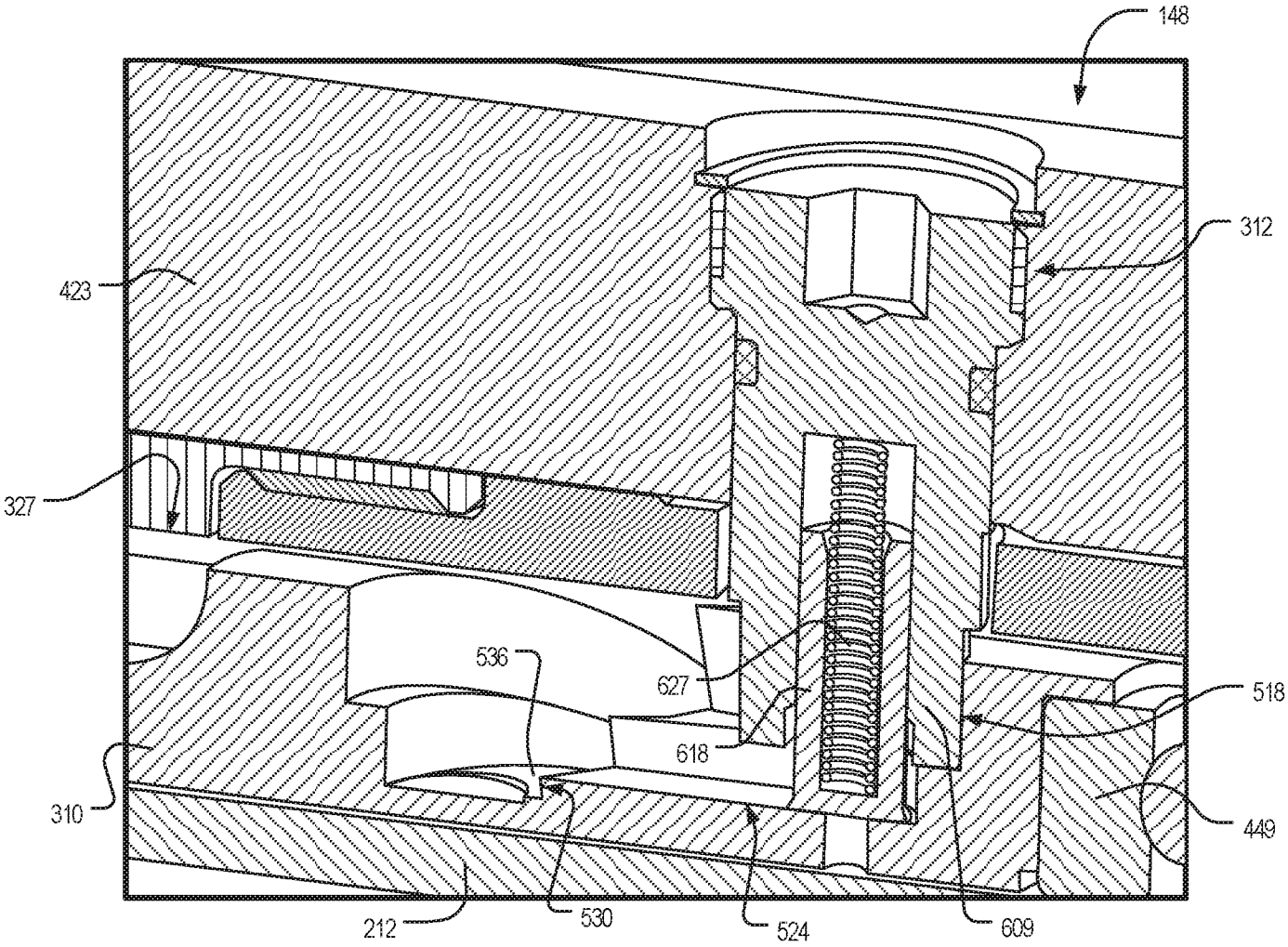
FIG. 6 depicts a longitudinally sectioned three-dimensional view of part of the drilling apparatus of FIG. 2, on an enlarged scale, showing details of a latch pin and barrel cam forming part of the drilling apparatus according to an example embodiment.

Turning now to FIGS. 5 and 6, it can be seen that a radially outer cylindrical surface of the example barrel cam 310 defines the track 315 that cooperates with the latch pin 312 in a cam/follower arrangement. The track 315 comprises an endless guide recess 518 that has a substantially even depth, extending circumferentially around the barrel cam 310, but varying in axial positions that can be occupied by the latch pin 312. The track 315 further comprises a locking channel 524 having a path identical to that of the guide recess 518, but having a smaller width and a greater depth. Described differently, the locking channel 524 is an elongate slot-like cavity in a floor of the guide recess 518.

The latch pin 312 in this example comprises a follower pin 609 that is mounted in the tubular wall 423 of the controller housing 215 to project radially inwards into the guide recess 518 with sliding clearance to bear against sidewalls of the guide recess 518 for translating axial movement of the valve piston 212 to rotational movement of the barrel cam 310.

The latch pin 312 further comprises a catch pin 618 housed co-axially in a blind socket in the follower pin 609. The catch pin 618 is telescopically slidable relative to the follower pin 609, projecting radially inwards from the radially inner end of the follower pin 609. The catch pin 618 is spring-loaded, being urged by a latch spring 627 away from the follower pin 609 to bear against a floor of the locking channel 524.

Unlike the guide recess 518, the locking channel 524 varies in depth along its length. Such depth variations include sudden depth changes at a number of latch steps 530, and gradual depth changes at which the floor of the locking channel 524 are inclined to form ramps 536 that act as cam surfaces that causes radial raising or lowering of the catch pin 618 when the follower pin 609 moves along the track 315.

In FIG. 5A, a portion of the track 315 that within which the latch pin 312 may be held captive to latch the controller 148 in the active condition (referred to herein as a latch slot) is generally indicated by chain-dotted line 512. Those portions of the track 315 corresponding to the dormant mode (referred to herein as an unlatch slot) are indicated in FIG. 5 by dotted line 506.

Note that an extreme downhole point of the unlatch slot 506 (point A) is located such that the valve piston 212 closes the valve port 218 when the latch pin 312 is at point A. When the latch pin 312 is at point A, it cannot move along the unlatch slot 506 to point E due to a step 530 on which the catch pin 618 fouls. Instead, downhole movement of the valve piston 212 causes movement of the barrel cam 310 such that the latch pin 312 moves along the unlatch slot 506 from point A to point B. Portion AB of the unlatch slot 506 defines a ramp 536 that pushes the catch pin 618 radially outwards.

If the latch pin 312 passes point B, it enters the latch slot 512 and cannot return to leg AB due to the step 530 at point B. The latch slot 512 has an extreme downhole position (point D) that is significantly short of point A, corresponding to a valve piston 212 position in which the valve port 218 is open. The latch slot 512 in this example comprises two portions (leg C-D and leg D-E), separated by a step 530 at point D. The floor of the locking channel 524 is inclined to provide ramps 536 from point C to point D, and from point D to point E. Another step 530 at point E prevents reentry of the latch pin 312 into the latch slot 512 once it has escaped the latch slot 512 by reaching point E, having then entered the unlatch slot 506 and being movable axially along the unlatch slot 506 from point E to point A.

Note that one cycle of the track 315 (e.g., from point A to point A) comprises only one third of the circumference of the barrel cam 310. The described cycle thus repeats three times, in this example, and the barrel cam 310 cooperates with three latch pins 312 at 120 degree intervals. See in this regard, e.g., FIGS. 8A-8G, in which the wall 423 is angularly sectioned to reveal two of the latch pins 312.

Stay Piston Features

Figure 7:
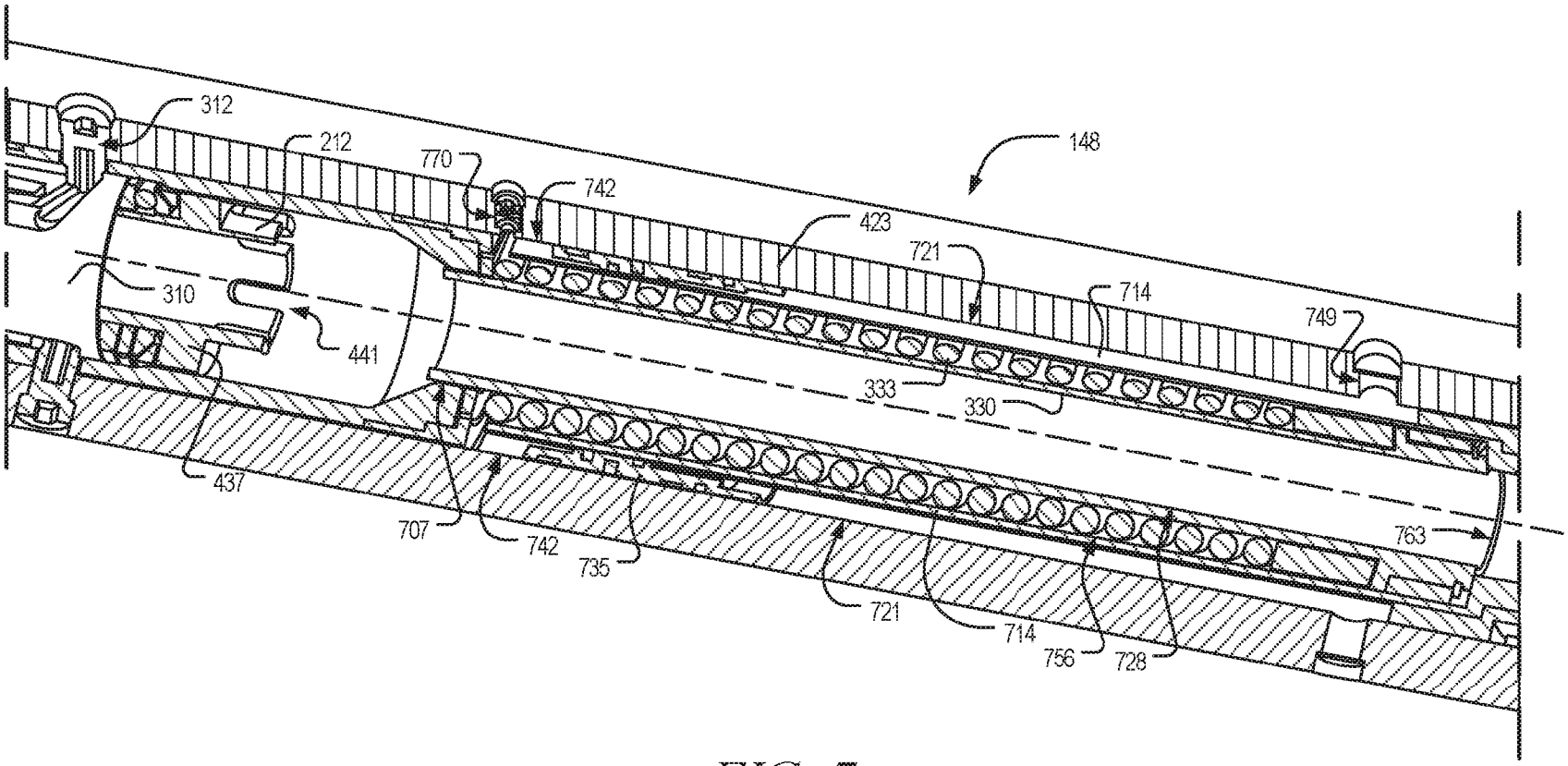
FIG. 7 depicts a three-dimensional longitudinal section of a part of the drilling apparatus of FIG. 2, on an enlarged scale, showing details of a stay piston of the drilling apparatus according to an example embodiment.

In FIG. 7, a stay piston according to an example embodiment is indicated by reference numeral 330. The example stay piston 330 is a hollow cylindrical member that is co-axially mounted in the controller housing 215. The stay piston 330 extends slidably through a constriction 707 in bore 128, being a sealed sliding fit in the constriction 707. Similar to the valve piston 212, a cylindrical passage 728 defined by the interior or the stay piston 330 is in-line with the bore 128 of the drill string 108, so that the passage 728 defines the bore 128 for the portion thereof coinciding with the stay piston 330.

The stay piston 330 is housed in a sleeve 714 co-axial with it. A tubular wall of the sleeve 714 is radially spaced both from the stay piston 330 and from an internal radially inner cylindrical surface of the controller housing wall 423, defining an annular cylindrical cavity 756 between the stay piston 330 and the sleeve 714, and defining between the sleeve 714 and the controller housing wall 423 an annular cylindrical cavity comprising an exposure chamber 721 and an equalization chamber 742 that are sealingly isolated from each other by a pressure balance piston 735.

The pressure balance piston 735 seals against the outer cylindrical surface of the sleeve 714 and against the inner cylindrical surface of the tubular housing wall 423, being axially slidable on the sleeve 714 to alter volumes of the exposure chamber 721 and the equalization chamber 742 in sympathy with one another. The equalization chamber 742 is in communication with the housing cavity 756 through holes in the sleeve 714 adjacent an uphole end of the sleeve 714 at the constriction 707. The stay spring 333 is co-axially mounted in the housing cavity 756, urging the stay piston 330 axially away from the constriction 707.

In this example, the equalization chamber 742 and the housing cavity 756 communicating therewith (effectively forming a single volume) is filled with a control fluid in the example form of oil.

The tubular wall 423 of the controller housing 215 defines a radially extending passage that provides an annulus opening 749. The annulus opening 749 places the exposure chamber 721 in fluid flow communication with the annulus 134, so that the exposure chamber 721 is in practice filled with drilling fluid (e.g., drilling mud), at fluid pressure values substantially equal to annulus pressure.

Because the pressure balance piston 735 is substantially free to move axially along the sleeve 714 responsive to hydraulic forces acting thereon, the pressure balance piston 735 dynamically adjusts its axial position to equalize fluid pressures between the exposure chamber 721 and the equalization chamber 742. As a result, oil pressure in the equalization chamber 742 (and therefore also in the housing cavity 756) is kept substantially equal to annulus pressure.

The equalization chamber 742 is in oil flow communication with the control fluid reservoir 321 (see FIG. 4) by an oil passage 770 in the housing wall 423, the oil passage 770 having openings to the control fluid reservoir 321 and the equalization chamber 742 (FIG. 7) respectively. The oil passage 770 serves to maintain the control fluid reservoir 321 substantially at annulus pressure.

Note that the control fluid reservoir 321, the draw chamber 327, the equalization chamber 742, and the housing cavity 756 are interconnected volumes holding control fluid (e.g., oil) that is automatically kept substantially at annulus pressure through operation of the balance piston 735, which is exposed to drilling fluid at annulus pressure in the exposure chamber 721. Remaining volumes in the interior of the controller 148 in operation hold drilling fluid, generally substantially at bore pressure.

The stay piston 330 has axial end face 763 at its downhole end. At high fluid pressure levels, the stay piston 330 is urged uphole (i.e., leftward in FIG. 7) against the bias of the stay spring 333 due to a pressure differential between the bore 128 and the housing cavity 756.

Example Controller Operation

An example sequence of operation of the controller 148 and the reamer assembly 118 is illustrated with reference to FIGS. 8A-8G.

Figure 8A:
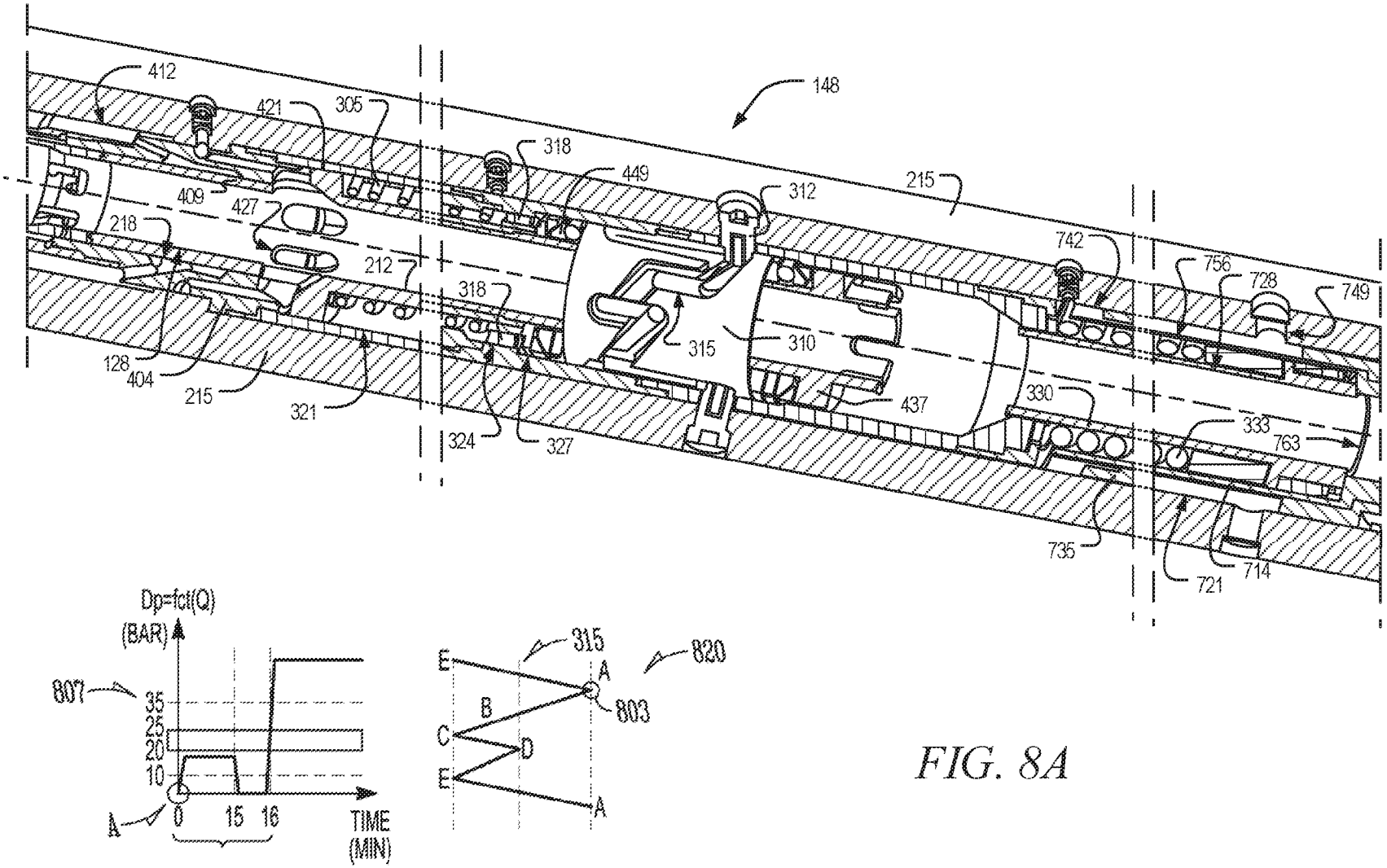
FIGS. 8A-8G each show a three dimensional longitudinal section of the drilling apparatus of FIG. 2 at various stages during controlled operation of the drilling apparatus, together with a pressure graph and a latch pin travel diagram corresponding to the condition of the associated longitudinal section, according to an example embodiment.

In FIG. 8A the controller 148 is shown initially to be in the dormant condition. Pressure graph 807 schematically shows bore-annulus pressure difference values over time. At first, drilling fluid in the bore 128 is not pressurized, so that the bore-annulus pressure difference is substantially zero.

In the absence of an effectively non-zero bore-annulus pressure difference, the valve piston 212 experiences no hydraulic actuation, and is urged by the closing spring 305 uphole (i.e., leftwards in FIG. 8A). Being in the dormant condition, the latch pin 312 is located in the unlatch slot 506. Due to operation of the closing spring 305, the latch pin 312 is located at point A, the valve piston 212 thus being at an extreme uphole position in which the valve closure sleeve 409 closes the valve port 218.

Diagram 820 in FIGS. 8A-8G schematically indicates travel of the latch pin 312 along the track 315. Points A to E in diagram 820 corresponds to points A to E of the track 315 described with reference to FIG. 5. Pin position indicator 803 schematically indicates location of the latch pin 312 at point A in the unlatch slot 506.

Figure 8B:
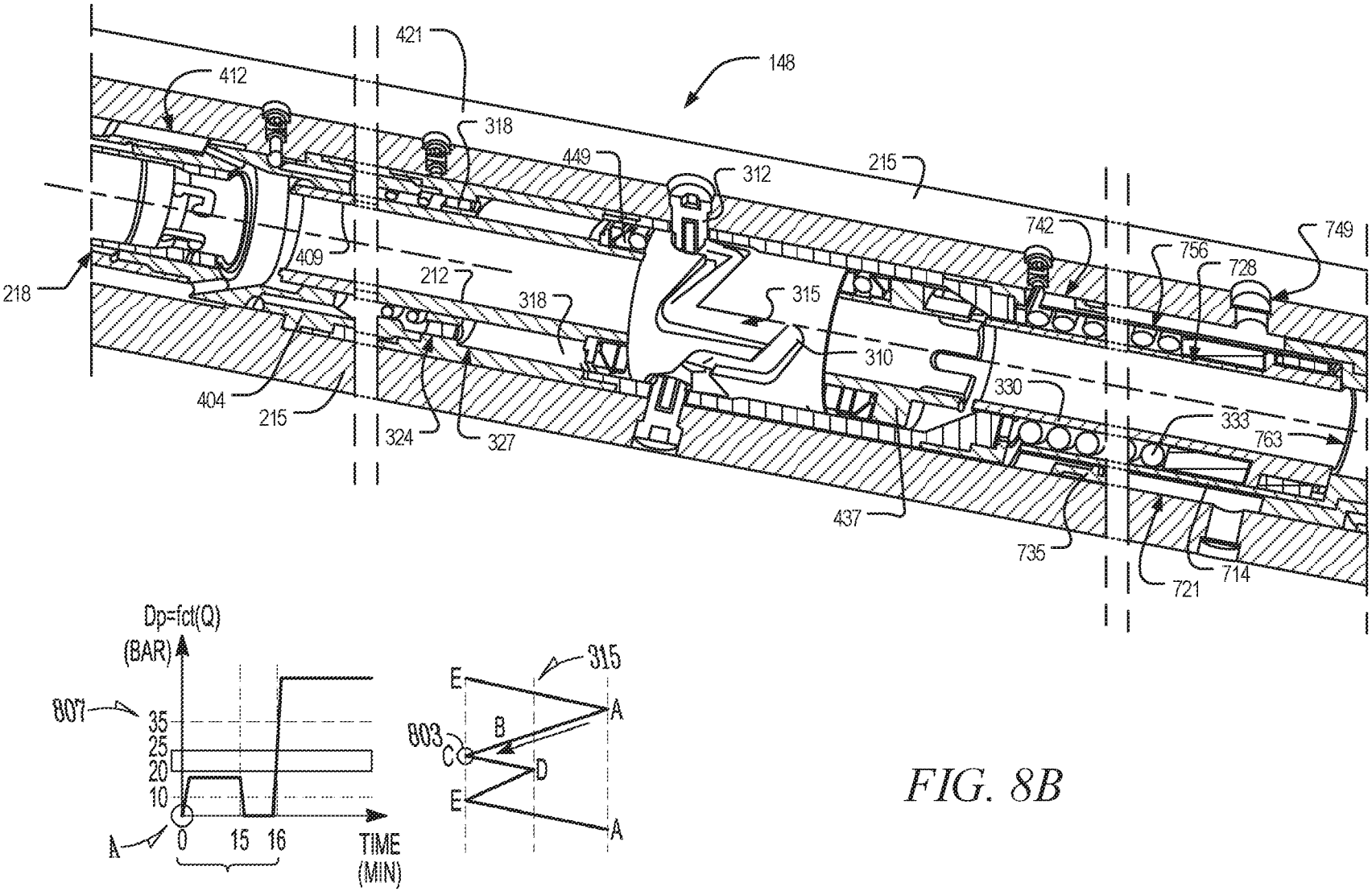
Figure 8C:
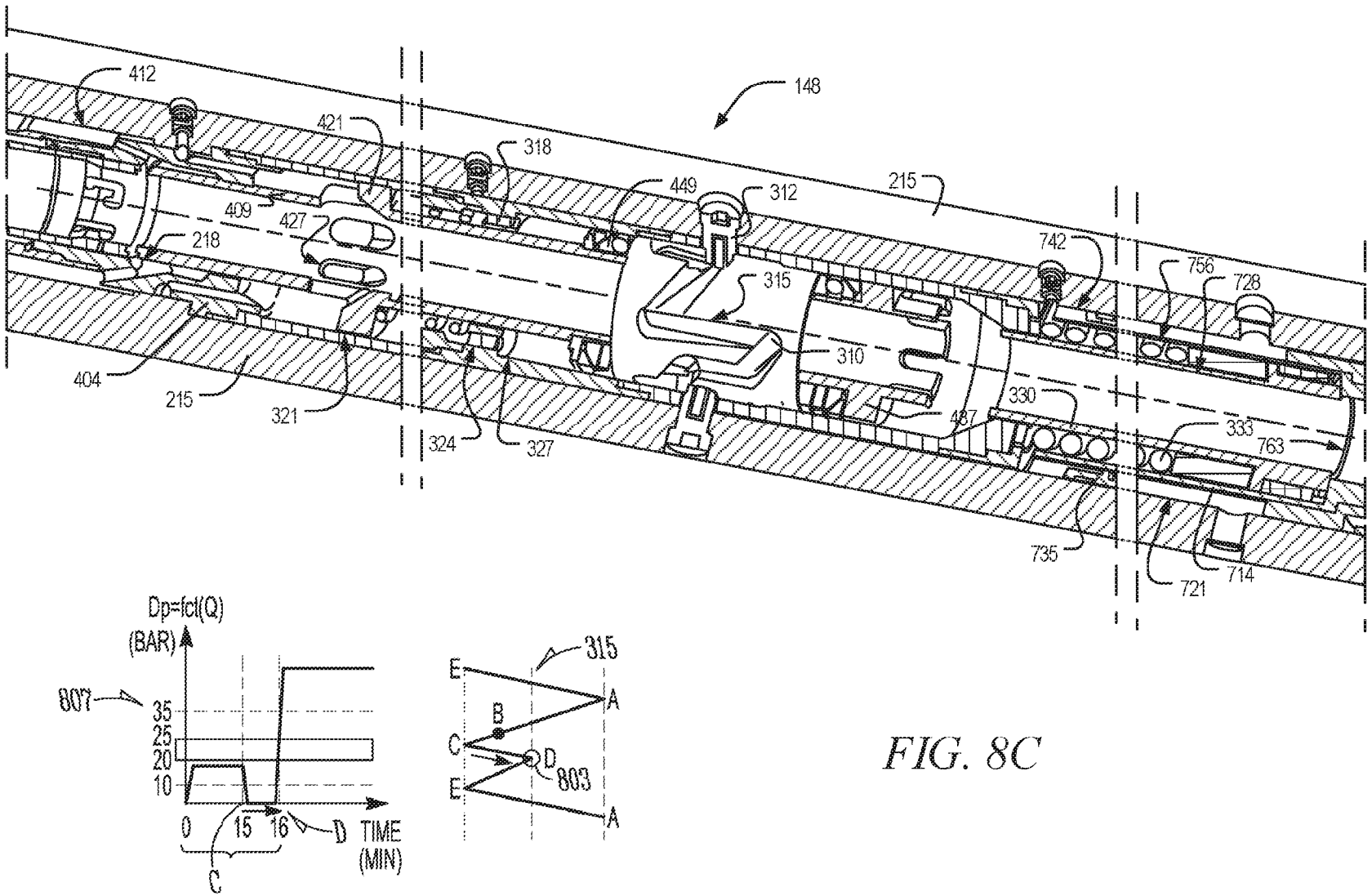

FIG. 8B shows the provision of fluid pressure conditions to change the controller 148 from the dormant condition to the active condition. In this example, drilling fluid control to switch to the active condition comprises maintaining a bore-annulus pressure difference below a trigger threshold value of about 20 bar for at least a trigger threshold interval of about 15 minutes.

The various components of the controller 148 (e.g., the hydraulic features of the valve piston 212 and the stay piston 330, and the parameters of the closing spring 305 and the stay spring 333) are selected such that below a bore-annulus pressure difference of 20 bar (being the trigger threshold value), net hydraulic forces on the stay piston 330 is insufficient to move the stay piston 330 uphole (i.e., leftwards in FIG. 8B) while net hydraulic forces on the due to the bore-annulus pressure difference is greater than a maximum resistive force that can be exerted thereon by the closing spring 305, so that the valve piston 212 is hydraulically actuated to move longitudinally downhole (i.e., rightwards in FIG. 8B).

The valve piston 212's downhole movement is retarded by operation of the flow restrictor 318 that limits the rate of fluid transfer from the control fluid reservoir 321 across the chamber wall 430 to the draw chamber 327. The latch pin 312 thus moves from point A to point C, entering the latch slot 512 at point B. Note that the latch mechanism of the control arrangement provided by the controller 148 is changed from the dormant mode to the active mode when the latch pin 312 reaches point B, entering the latch slot 512. Thus, point B in this instance comprises a mode change position of the latch pin 312, with a corresponding longitudinal position of the valve piston 212 comprising a mode change position of the valve piston 212.

Note further that cessation of the bore-annulus pressure difference before the latch pin 312 reaches point B in the track 315 would result in return of the latch pin 312 to point A due to uphole movement of the valve piston 212 under the urging of the closing spring 305.

After provision of the mode switching pressure conditions illustrated in FIG. 8B, pumping of drilling fluid through the bore 128 may be ceased for at least a predefined interval. Note, again, that the valve piston 212 is urged towards its closed position in the absence of a bore-annulus pressure difference by the closing spring 305.

In the example, provision of a substantially zero bore-annulus pressure difference for a pressure cessation interval of about one minute (see pressure graph 807 in FIG. 8C) is sufficiently long to move the valve piston 212 to an extreme uphole position achievable by the valve piston 212 in the latched condition. This extreme uphole latched position corresponds to location of the latch pin 312 at point D (see the condition of the controller 148 shown in FIG. 8C. When the latch pin 312 reaches point D in the track 315, it passes the step 530 at that point and abuts against the walls of the track 315, resisting further uphole movement of the valve piston 212 under the bias of the closing spring 305. Due to abutment also against the step 530 at point D, the only available movement for the latch pin 312 from point D is along leg DE of the latch slot 512.

Note that when the latch pin 312 is at point D in the track 315, the valve closure sleeve 409 is clear of the valve port 218, exposing the reamer assembly 118 to bore pressures. The latch pin 312's only path of escape from the latch slot 512, to permit closing of the valve port 218 is to reach point E (comprising a mode change position) along leg DE, to thereafter enable sufficient uphole movement of the valve piston 212 (e.g., for the latch pin 312 to again approach point A). As will presently be seen, however, downhole movement of the valve piston 212 is obstructed or stopped by the stay piston 330 if the movement of valve piston 212 is under hydraulic actuation due to a bore-annulus pressure difference greater than the trigger threshold value.

Figure 8D:
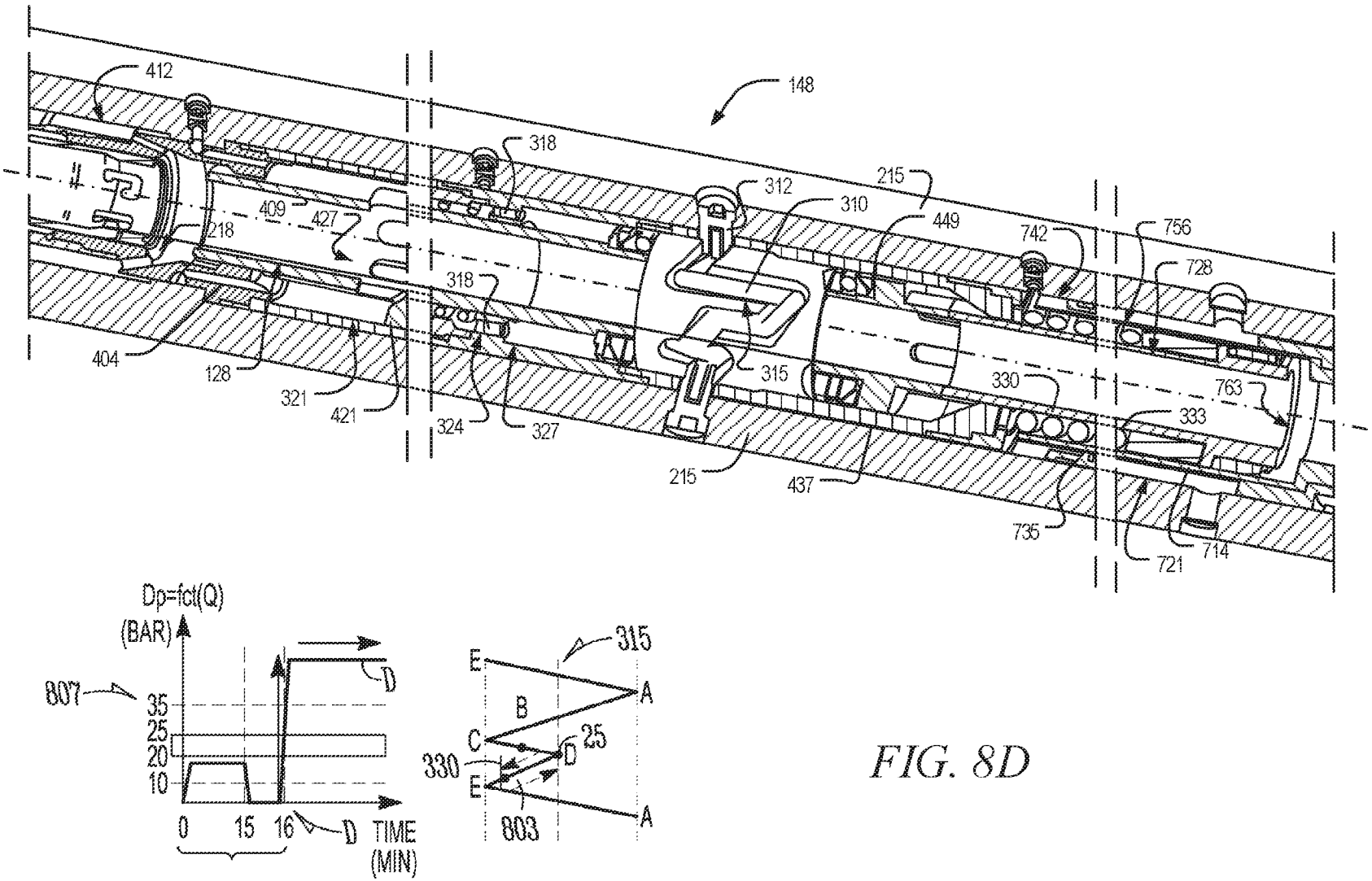

FIG. 8D shows and example instance where the bore-annulus pressure difference is ramped up beyond the trigger threshold value of between 20 and 25 bar of the present example. As schematically shown along leg DE of the track 315 in the track diagram of FIG. 8D, the stay piston 330 moves uphole (leftwards in FIG. 8D) under hydraulic actuation faster than the valve piston 212 moves downhole (rightwards in FIG. 8D), meeting the valve piston 212 in end-to-end abutment therewith before the latch pin 312 has reached the mode change position of point E. The controller 148 of FIG. 8D is shown in a condition shortly before the stay piston 330 stops the valve piston 212. When the stay piston 330 and the valve piston 212 come into end-to-end abutment, the valve piston 212 is shunted uphole by the stay piston 330, thus keeping the latch pin 312 in the latch slot 512 and moving the latch pin 312 back towards point D.

The stay piston 330 thus serves to block escape of the latch pin 312 from the latch slot 512 responsive to pressure conditions in which the bore-annulus pressure difference exceeds the trigger threshold value. Thus, the described latch mechanism and the stay piston 330 serve to dispose the controller 148 in the active condition, because the valve port 218 remains open regardless of the application of operational bore pressures (at which the bore-annulus pressure difference exceeds the trigger threshold value), the latch pin 312 being trapped in the latch slot 512. The result is that the reamer assembly 118 automatically deploys responsive to the application of operational bore pressures.

Note that even though the stay piston 330 is hydraulically actuated uphole against a greater spring resistance (providing by the stay spring 333) than the spring resistance (provided by the closing spring 305) experienced by the valve piston 212, the superior rapidity of the stay piston's (330) hydraulically actuated uphole movement is enabled by retardation of movement of the valve piston 212 by operation of the flow restrictor 318, as previously described.

Figure 8E:
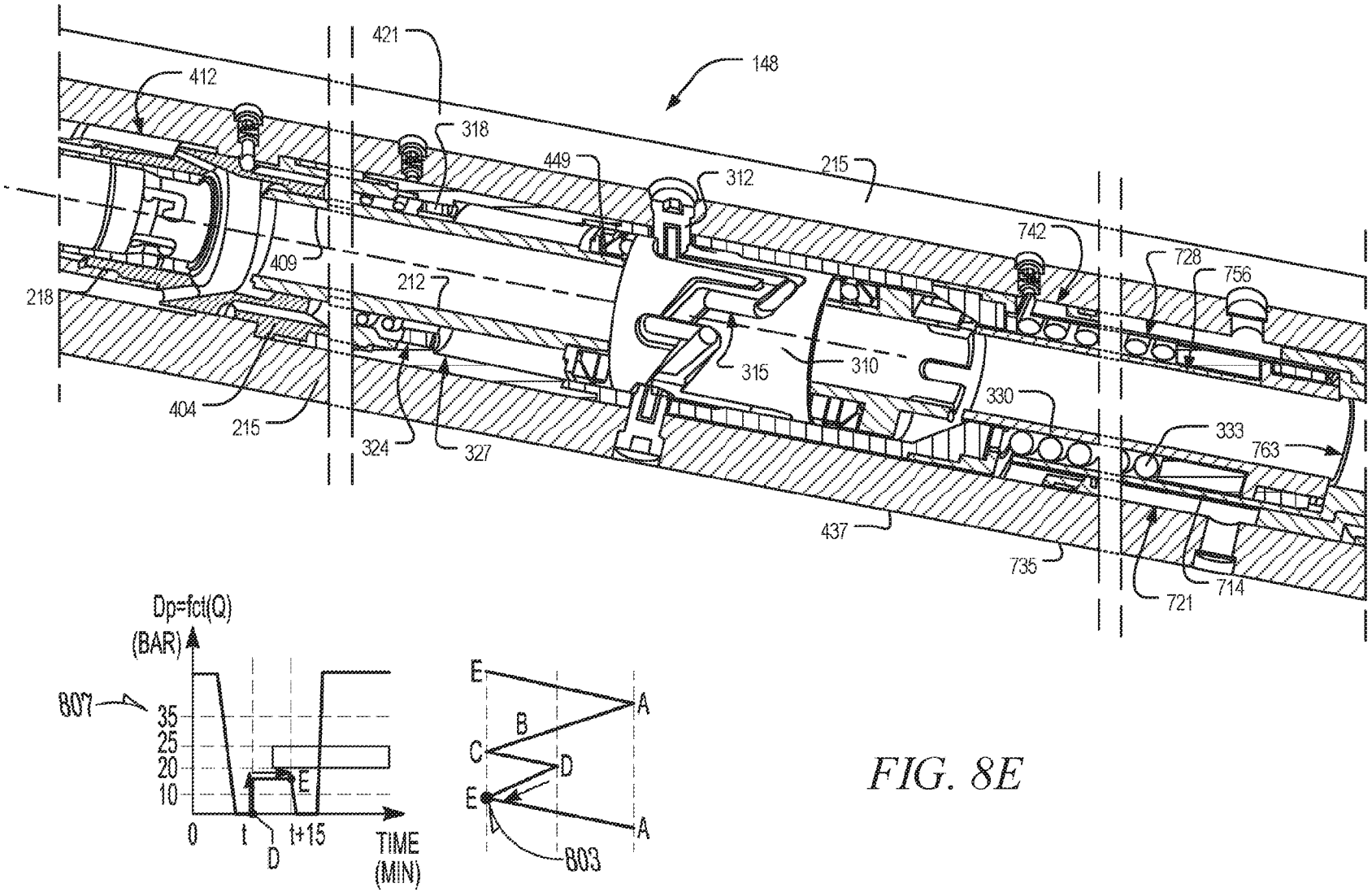

Escape of the latch pin 312 from the latch slot 512 is achievable only by provision of predefined mode change fluid pressure conditions. In this example, the mode change fluid pressure conditions to change from the active mode to the dormant mode are similar to those for changing from the dormant mode to the active mode. FIG. 8E shows pressure conditions controlled by an operator or automated system at the surface control system 140.

In this example, the bore pressure is selectively changed to provide a bore-annulus pressure difference below the trigger threshold value (here, for example, on the order of 20-25 bar) for at least a trigger threshold interval, again being about 15 minutes. As before, the stay piston 330 remains stationary in its rest position in which it clears the valve piston's 212 path to allow movement of the valve piston 212 to a mode change position corresponding to escape of the latch pin 312 from the latch slot 512 by passage of the latch pin 312 over the step 530 at point E. As is the case with each of points A-D, point E is effectively a point of no return for the latch pin 312 along the latch slot 512 due to fouling of the catch pin 618 on the corresponding step 530. Thus, when the latch pin 312 reaches point E, it is trapped in the unlatch slot 506 being movable from point E only along leg E-A of the track 315 towards point A. Note that the controller 148 is changed from the active condition to the dormant condition when the latch pin 312 enters the unlatch slot 506 at point E.

Figure 8F:
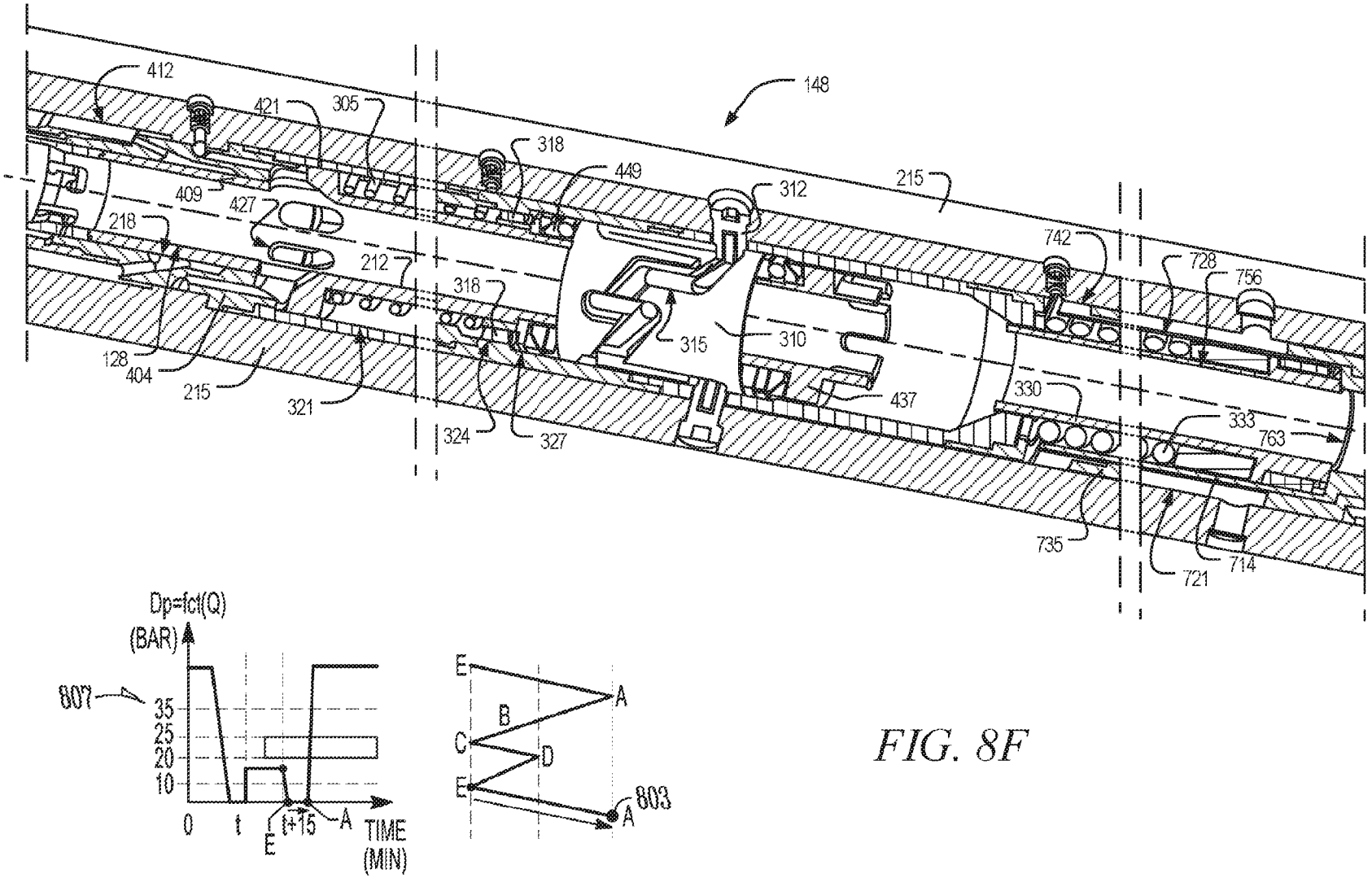

Once the latch pin 312 is in the unlatch slot 506, the valve piston 212 is free to move longitudinally uphole either under the urging of the closing spring 305 (in the absence of bore-annulus pressure difference) or by being shunted uphole by the stay piston 330 (at high bore-annulus pressure difference values), so that the latch pin 312 moves from point E back to the starting position (point A), as shown schematically in FIG. 8F. In this example, the operator provides a bore-annulus pressure difference at or near zero bar after the 15 minute mode-switching low pressure interval (see FIG. 8E), resulting in automatic spring-actuated movement of the valve piston 212 uphole to its extreme uphole position in the unlatched condition (point A), to close the valve port 218.

Figure 8G:
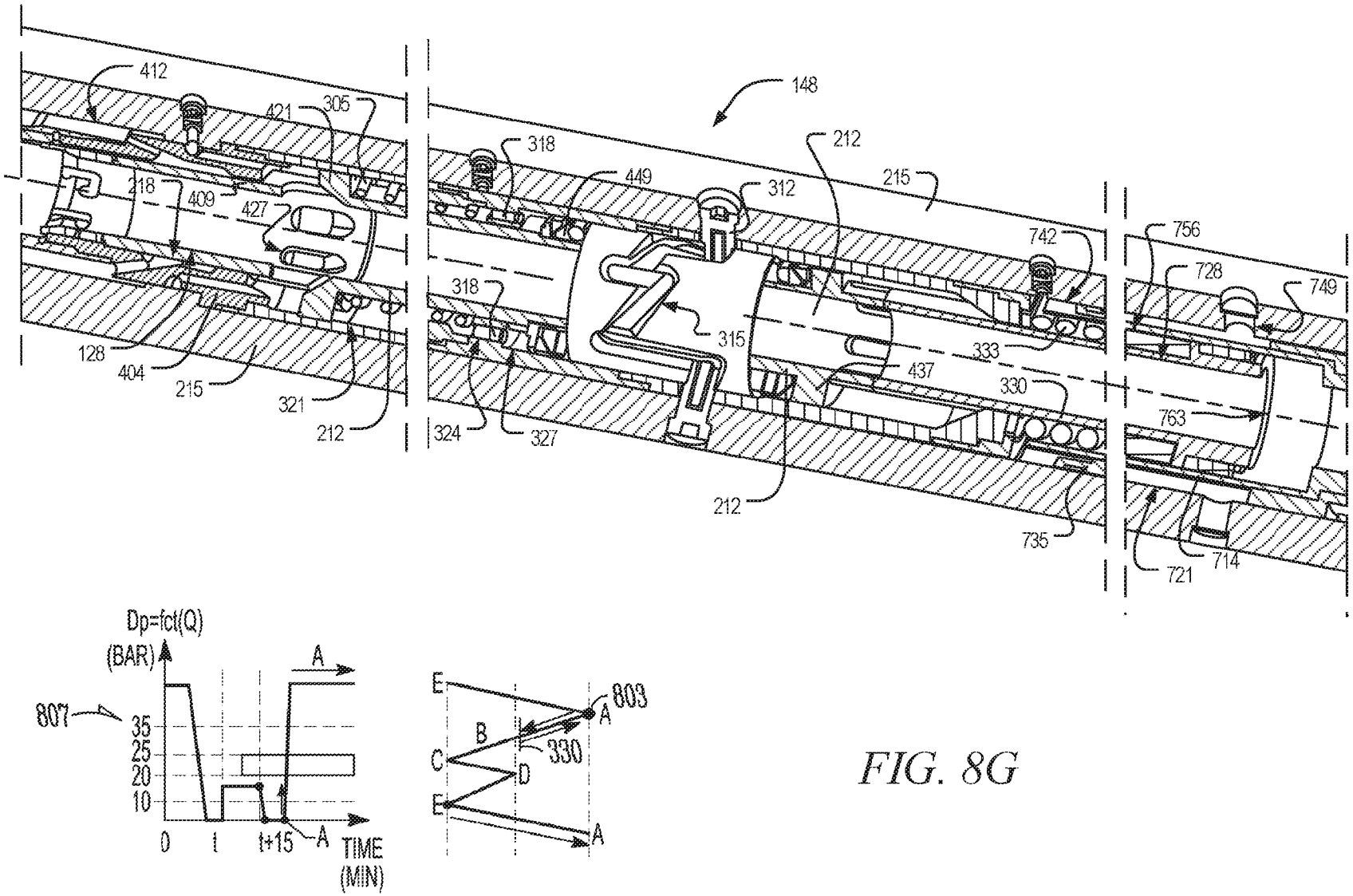

FIG. 8G shows operation of the stay piston 330 to keep the latch pin 312 in the unlatch slot 506 responsive to application of bore-annulus pressure differences above the trigger threshold value. When such a high operational pressure, at which the respective downhole tool is deployed (referred to herein as operational tool pressures), is applied, the stay piston 330 moves uphole (also referred to herein as the first longitudinal direction) under hydraulic actuation faster than valve piston 212 moves downhole (also referred to herein as the second longitudinal direction), to abut end-to-end against the valve piston 212 before it reaches the mode change position defined by point B. In this example, the valve piston 212 is stopped before the valve port 218 is opened. Thus, the controller 148 is in the dormant mode, the reamer assembly 118 being unresponsive to operational bore pressures.

By the above-described methods and systems, control of downhole tool exclusively through control of bore pressure is achieved. It is a benefit that, once the controller 148 is in the active mode, the reamer assembly 118 (or any other downhole tool that may be connected to the controller 148 instead) may be deployed and retracted repeatedly simply by ramping up bore pressure. In the dormant mode, drilling fluid pressures can be provided as required, without concern for inadvertent deployment of the relevant tool, e.g. the reamer assembly 118, because accidental application of the described mode switching bore conditions (e.g., continuous low flow/pressure for 15 minutes or more) is unlikely.

Thus, a method and system control downhole tool activation by remote fluid pressure control have been described. Some embodiments provide a drilling apparatus a generally tubular housing to form an in-line part of an elongated drill string extending longitudinally along a borehole, the housing defining a longitudinally extending bore to convey drilling fluid under pressure, a bore-annulus pressure difference being defined between drilling fluid pressure in the bore and drilling fluid pressure in an annulus that radially spaces the housing from a borehole wall. A control arrangement may be mounted in the housing to control response of a downhole tool in the drill string to variations in the bore-annulus pressure difference, the control arrangement defining a valve port that is connectable to a hydraulic activation mechanism of the downhole tool (e.g., reamer assembly 118), the control arrangement further comprising a valve piston that is longitudinally displaceable in the housing to dispose the valve port between an open condition, to permit fluid pressure communication between the bore and the activation mechanism of the downhole tool, and a closed condition, to substantially isolate the activation mechanism from the bore. The example apparatus further comprises a latch mechanism (including, e.g., barrel cam 310 and latch pin 312) to releasably latch the valve piston to the housing to restrain relative longitudinal movement of the valve piston in a first longitudinal direction (e.g., in the uphole direction, towards closure of the valve port), the valve piston, when latched, being releasable by movement thereof in an opposite, second longitudinal direction (e.g., in the downhole direction) to a mode change position (e.g., by the latch pin 312 reaching mode change point E on the barrel cam 310, point B being a mode change position when valve piston 212 is unlatched). In this embodiment, latching or release of the valve piston changes an operational mode of the control arrangement between an active mode in which the valve port in its open condition upon application of bore pressures at or above tool activation levels, to permit hydraulic tool activation, and a dormant mode in which the valve port in its closed condition upon application of bore pressures at or above tool actuation levels, to prevent hydraulic tool activation. The example drilling apparatus further comprises a stay member (e.g., stay piston 330) that is automatically displaceable under hydraulic actuation responsive to provision of the bore-annulus pressure difference above a trigger threshold value, to obstruct movement of the valve piston, when latched, under hydraulic actuation to the mode change position.

Although the present invention has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

For example, staying mechanisms different from the stay piston 330 may be employed to obstruct movement of the valve piston 212, in some embodiments. Note also that although the described control arrangement finds particularly beneficial application in combination with a reamer assembly, these techniques can profitably be employed in combination with a variety of other downhole tools, including, for example, adjustable gage stabilizers, jars, dump valves, valves, packers, flow control devices or any hydraulically actuated mechanism in which its state needs to be controlled at will from surface.

The described example embodiments therefore disclose, inter alia, a well tool apparatus to control a downhole tool in a drill string which will extend longitudinally along a borehole, the well tool apparatus comprising a generally tubular housing configured to form an in-line part of the drill string, the housing defining a longitudinally extending bore to convey drilling fluid under pressure, a bore-annulus pressure difference being defined between drilling fluid pressure in the bore and drilling fluid pressure in an annulus that radially spaces the housing from walls defining the borehole; and a control arrangement mounted in the housing, the control arrangement being configured to control response of the downhole tool in response to variations in the bore-annulus pressure difference, the control arrangement defining a valve port that is connectable to a hydraulic activation mechanism of the downhole tool.

The control arrangement comprises: a valve piston that is longitudinally displaceable in the housing to dispose the valve port between an open condition which permits fluid pressure communication between the bore and the activation mechanism of the downhole tool, and a closed condition which substantially isolates the activation mechanism from the bore; and a latch mechanism configured to releasably latch the valve piston to the housing to restrain relative longitudinal movement of the valve piston in a first longitudinal direction, wherein the latched valve piston is releasable by movement thereof in an opposite, second longitudinal direction to a mode change position in which the an operational mode of the control arrangement changes between, on the one hand, an active mode in which the valve port is in an open condition upon application of bore pressures at or above tool activation levels, to permit hydraulic tool activation, and, on the other hand, a dormant mode in which the valve port is in a closed condition upon application of bore pressures at or above tool activation levels, to prevent hydraulic tool activation.

The control arrangement further comprises a stay member that is automatically displaceable under hydraulic actuation responsive to provision of the bore-annulus pressure difference above a trigger threshold value, to obstruct movement of the latched valve piston under hydraulic actuation to the mode change position.

The stay member may be a stay piston longitudinally aligned with the valve piston and being longitudinally displaceable under hydraulic actuation in the first longitudinal direction, towards engagement with the valve piston. In such a case, the control arrangement may further comprise a closing bias arrangement configured to urge the valve piston in the first longitudinal direction, towards closure of the valve port and against hydraulically actuated movement of the valve piston, and a staying bias arrangement configured to urge the stay member in the second longitudinal direction, away from the valve piston and against hydraulically actuated movement of the valve piston, the staying bias arrangement exerting a greater biasing force than the closing bias arrangement and being selected such that there is a range of bore-annulus pressure difference values at which hydraulically actuated movement of the stay piston is substantially prevented by the staying bias arrangement, while achieving hydraulically actuated movement of the valve piston against the closing bias arrangement.

The well tool apparatus may further comprise a retarding arrangement to retard hydraulically actuated movement of the valve piston in the second longitudinal direction, to facilitate obstructing engagement of the stay piston with the valve piston before the valve piston, when latched, reaches the mode change position. The regarding arrangement may comprise: a plurality of cooperating flow control chambers operatively connected to the valve piston such that longitudinal movement of the valve piston is dependent on corresponding fluid transfer between the cooperating flow control chambers; a fluid passage connecting at least two of the plurality of cooperating flow control chambers; and a flow restrictor in the fluid passage configured to restrict fluid flow between the flow control chambers to a predefined fluid flow rate in response to a pressure differential between the flow control chambers, thereby to limit hydraulically actuated longitudinal movement of the valve piston to a predefined speed.

The downhole tool may be a reamer assembly that comprises a tubular reamer body longitudinally aligned with and connected to the housing to place the activation mechanism of the reamer assembly in fluid pressure communication with the valve port, and one or more cutting elements mounted on the reamer body and configured to ream the borehole wall, the cutting elements being disposable responsive to bore pressure conditions between a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

The latch mechanism may be configured such that hydraulically actuated movement of the valve piston, when latched, in the second longitudinal direction from a latched rest position to the mode change position responsive to a substantially constant bore-annulus pressure difference is achievable only by provision of the bore-annulus pressure difference at a level below the trigger threshold value and for at least a trigger threshold interval.

The latch mechanism may comprise a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at changing longitudinal positions, the latch mechanism further comprising a latch member mounted on the housing to project radially inwards therefrom, the latch member being received in the track recess in cam-following engagement with the track recess, the track recess being shaped such that longitudinal movement of the barrel cam relative to the latch member causes rotation of the barrel cam.

The track recess may comprise: a latch slot shaped such that, when the latch member is in the latch slot, closure of the valve port by longitudinal movement of the valve piston under urging of the closing bias arrangement is prevented by engagement of the latch member with the latch slot; and an unlatch slot shaped to permit movement of the latch member along it to a position in which the valve port is closed.

The described embodiments further disclose a drilling installation which includes the well tool apparatus, as well as a method comprising use of the well tool apparatus.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A well tool apparatus to control a downhole tool in a drill string which will extend longitudinally along a borehole, comprising:

a generally tubular housing configured to form an in-line part of the drill string, the housing defining a longitudinally extending bore to convey drilling fluid under pressure, a bore-annulus pressure difference being defined between drilling fluid pressure in the bore and drilling fluid pressure in an annulus that radially spaces the housing from walls defining the borehole; and a control arrangement mounted in the housing configured to control response of the downhole tool in response to variations in the bore-annulus pressure difference, the control arrangement defining a valve port that is connectable to a hydraulic activation mechanism of the downhole tool, the control arrangement further comprising a valve piston that is longitudinally displaceable in the housing to dispose the valve port between an open condition which permits fluid pressure communication between the bore and the activation mechanism of the downhole tool, and a closed condition which substantially isolates the activation mechanism from the bore;

a latch mechanism configured to releasably latch the valve piston to the housing to restrain relative longitudinal movement of the valve piston in a first longitudinal direction, wherein the latched valve piston is releasable by movement thereof in an opposite, second longitudinal direction to a mode change position in which an operational triode of the control arrangement changes between, an active mode in which the valve port is in an open condition upon application of bore pressures at or above tool activation levels, to permit hydraulic tool activation, and a dormant mode in which the valve port is in a closed condition upon application of bore pressures at or above tool activation levels, to prevent hydraulic tool activation; and a stay piston that is automatically displaceable under hydraulic actuation of the stay piston responsive to provision of the bore-annulus pressure difference above a trigger threshold value, to obstruct movement of the latched valve piston under hydraulic actuation to the mode change position.

2. The well tool apparatus of claim 1, wherein the stay piston is longitudinally aligned with the valve piston and longitudinally displaceable under hydraulic actuation in the first longitudinal direction, towards engagement with the valve piston, the control arrangement further comprising:

a closing bias arrangement configured to urge the valve piston in the first longitudinal direction, towards closure of the valve port and against hydraulically actuated movement of the valve piston;

a staying bias arrangement configured to urge the stay piston in the second longitudinal direction, away from the valve piston and against hydraulically actuated movement of the valve piston, the staying bias arrangement being greater than the closing bias arrangement and being selected such that there is a range of bore-annulus pressure difference values at which hydraulically actuated movement of the stay piston is substantially prevented by the staying bias arrangement, while achieving hydraulically actuated movement of the valve piston against the closing bias arrangement.

3. The well tool apparatus of claim 1, further comprising a retarding arrangement to retard hydraulically actuated movement of the valve piston in the second longitudinal direction to facilitate obstructing engagement of the stay piston with the valve piston before the valve piston, when latched, reaches the mode change position, the retarding arrangement comprising:

a plurality of cooperating flow control chambers operatively connected to the valve piston such that longitudinal movement of the valve piston is dependent on corresponding fluid transfer between the cooperating flow control chambers;

a fluid passage connecting at least two of the plurality of cooperating low control chambers; and a flow restrictor in the fluid passage configured to restrict fluid flow between the flow control chambers to a predefined fluid flow rate in response to a pressure differential between the flow control chambers, thereby to limit hydraulically actuated longitudinal movement of the valve piston to a predefined speed.

4. The well tool apparatus of claim 1, wherein the downhole tool comprises a reamer assembly, the reamer assembly comprising:

a tubular reamer body longitudinally aligned with and connected to the housing to place the activation mechanism of the reamer assembly in fluid pressure communication with the valve port; and one or more cutting elements mounted on the reamer body and configured to ream the borehole wall, the cutting elements being disposable responsive to bore pressure conditions between, a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

5. The well tool apparatus of claim 1, wherein the latch mechanism is configured such that hydraulically actuated movement of the valve piston, when latched, in the second longitudinal direction from a latched rest position to the mode change position responsive to a substantially constant bore-annulus pressure difference is achievable only by provision of the bore-annulus pressure difference at a level below the trigger threshold value and for at least a trigger threshold interval.

6. The well tool apparatus of claim 5, wherein the trigger threshold interval is greater than 5 minutes.

7. The well tool apparatus of claim 1, wherein latch mechanism comprises:

a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at variable longitudinal positions; and a latch member mounted on the housing to project radially inwards therefrom, the latch member being received in the track recess in cam-following engagement with the track recess, the track recess being shaped such that longitudinal movement of the barrel cam relative to the latch member causes rotation of the barrel cam.

8. The well tool apparatus of claim 7, wherein the track recess comprises:

a latch slot shaped such that, when the latch member is in the latch slot, closure of the valve port by longitudinal movement of the valve piston under urging of the closing bias arrangement is prevented by engagement of the latch member with the latch slot; and an unlatch slot shaped to permit movement of the latch member along it to a position in which the valve port is closed.

9. A drilling installation comprising:

an elongated drill string extending longitudinally along a borehole, the drill string defining a longitudinally extending bore to convey drilling fluid under pressure in response to a bore-annulus pressure difference defined between drilling fluid pressure in the bore and drilling fluid pressure in an annulus that radially spaces the drill string from a borehole wall;

a downhole tool forming part of the drill string, the downhole tool having a hydraulic activation mechanism to activate the downhole tool; and a control arrangement mounted forming part of the drill string to control response of the downhole tool to variations in the bore-annulus pressure difference, the control arrangement defining a valve port connected to the activation mechanism of the downhole tool, the control arrangement further comprising, a valve piston that is longitudinally displaceable in the drill string and configured to dispose the valve port between an open condition which permits fluid pressure communication between the bore and the activation mechanism of the downhole tool, and a closed condition which substantially isolates the activation mechanism from the bore;

a latch mechanism configured to releasably latch the valve piston to restrain longitudinal movement of the valve piston relative to the drill string in a first longitudinal direction, the valve piston, when latched, being releasable by movement thereof in an opposite, second longitudinal direction to a mode change position, latching or release of the valve piston changing an operational mode of the control arrangement between, an active mode in which the valve port in its open condition upon application of bore pressures at or above tool activation levels, to permit hydraulic tool activation via the bore, and a dormant mode in which the valve port in its closed condition upon application of bore pressures at or above tool activation levels, to prevent hydraulic tool activation; and a stay piston that is automatically displaceable under hydraulic actuation of the stay piston to a position obstructing movement of the latched valve piston to the mode change position.

10. The drilling installation of claim 9, wherein the stay piston is longitudinally aligned with the valve piston, the stay piston being longitudinally displaceable under hydraulic actuation in the first longitudinal direction, towards engagement with the valve piston, the control arrangement further comprising:

a closing bias arrangement to urge the valve piston in the first longitudinal direction, towards closure of the valve port and against hydraulically actuated movement of the valve piston;

a staying bias arrangement to urge the stay piston in the second longitudinal direction, away from the valve piston and against hydraulically actuated movement of the valve piston, the staying bias arrangement being greater than the closing bias arrangement and being selected such that, there is a range of bore-annulus pressure difference values at which hydraulically actuated movement of the stay piston is substantially prevented by the staying bias arrangement, while achieving hydraulically actuated movement of the valve piston against the closing bias arrangement.

11. The drilling installation of claim 9, further comprising a retarding arrangement to retard hydraulically actuated movement of the valve piston in the second longitudinal direction to facilitate obstructing engagement of the stay piston with the valve piston before the valve piston, when latched, reaches the mode change position, the retarding arrangement comprising:

two or more cooperating flow control chambers operatively connected to the valve piston such that longitudinal movement of the valve piston is dependent on corresponding fluid transfer between the two-or more cooperating flow control chambers;

a fluid passage connecting the two-or more cooperating flow control chambers; and a flow restrictor in the fluid passage to restrict fluid flow between the flow control chambers to a predefined fluid flow rate in response to a pressure differential between the flow control chambers, thereby to limit hydraulically actuated longitudinal movement of the valve piston to a predefined speed.

12. The drilling installation of claim 9, wherein the downhole tool comprises a reamer assembly comprising one or more cutting elements to ream the borehole wall, the cutting elements being disposable responsive to bore pressure conditions between a deployed condition in which the one or more cutting elements project radially outwards from the drill string to engage the borehole wall, and a retracted condition in which the one or more cutting elements are retracted to permit rotation of the drill string free from engagement of the one or more cutting elements with the borehole wall.

13. The drilling installation of claim 9, wherein the latch mechanism is configured such that hydraulically actuated movement of the valve piston, when latched, in the second longitudinal direction from a latched rest position to the mode change position responsive to a substantially constant bore-annulus pressure difference is achievable only by provision of the bore-annulus pressure difference at a level below the trigger threshold value and for at least a trigger threshold interval.

14. The drilling installation of claim 9, wherein latch mechanism comprises:

a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at variable longitudinal positions; and a latch member mounted on a drill string body to project radially inwards therefrom, the latch member being received in the track recess in cam-following engagement with the track recess, the track recess being shaped such that longitudinal movement of the barrel cam relative to the latch member translates to rotation of the barrel earn.

15. A method of controlling a downhole tool coupled in a drill string extending longitudinally along a borehole, comprising:

controlling response of the downhole tool in the drill string to variations in a bore-annulus pressure difference by a control arrangement mounted in the drill string, the control arrangement defining a valve port that is connectable to a hydraulic activation mechanism of the downhole tool, the control arrangement further comprising, a valve piston that is longitudinally displaceable in the drill string to dispose the valve port between an open condition, to permit fluid pressure communication between a drill string bore and the activation mechanism of the downhole tool, and a closed condition, to substantially isolate the activation mechanism from the drill string bore; and a latch mechanism configured to releasably latch the valve piston to the drill string restrain relative longitudinal movement of the valve piston in a first longitudinal direction, the valve piston, when latched, being releasable by movement thereof in an opposite, second longitudinal direction to a mode change position, wherein latching or releasing of the valve piston changes an operational mode of the control arrangement between, an active mode in which the valve port in its open condition upon application of bore pressures at or above tool activation levels, permits hydraulic tool activation, and a dormant mode in which the valve port its closed condition upon application of bore pressures at or above tool activation levels, prevents hydraulic tool activation; and a stay piston that is automatically displaceable under hydraulic actuation of the stay piston responsive to a pressure difference above a trigger threshold value, to obstruct movement of the latched valve piston toward the mode change position.

16. The method of claim 15, wherein the stay piston is longitudinally aligned with the valve piston and longitudinally displaceable under hydraulic actuation in the first longitudinal direction, towards engagement with the valve piston, the control arrangement further comprising:

a closing bias arrangement to urge the valve piston in the first longitudinal direction, towards closure of the valve port and against hydraulically actuated movement of the valve piston;

a staying bias arrangement to urge the stay piston in the second longitudinal direction, away from the valve piston and against hydraulically actuated movement of the valve piston, the staying bias arrangement being greater than the closing bias arrangement and being selected such that there is a range of bore-annulus pressure difference values at which hydraulically actuated movement of the stay piston is substantially prevented by the staying bias arrangement, while achieving hydraulically actuated movement of the valve piston against the closing bias arrangement.

17. The method of claim 15, further comprising a retarding arrangement to retard hydraulically actuated movement of the valve piston in the second longitudinal direction to facilitate obstructing engagement of the stay piston with the valve piston before the valve piston, when latched, reaches the mode change position, the retarding arrangement comprising:

two or more cooperating flow control chambers operatively connected to the valve piston such that longitudinal movement of the valve piston is dependent on corresponding fluid transfer between the cooperating flow control chambers;

a fluid passage connecting the two-or more cooperating flow control chambers; and a flow restrictor in the fluid passage to restrict fluid flow between the flow control chambers to a predefined fluid flow rate in response to a pressure differential between the flow control chambers, thereby to limit hydraulically actuated longitudinal movement of the valve piston to a predefined speed.

18. The method of claim 15, wherein the latch mechanism is configured such that hydraulically actuated movement of the valve piston, when latched, in the second longitudinal direction from a latched rest position to the mode change position responsive to a substantially constant bore-annulus pressure difference is achievable only by provision of a bore-annulus pressure difference at a level below the trigger threshold value and for at least a trigger threshold interval.

19. The method of claim 15, wherein latch mechanism comprises:

a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at variable longitudinal positions; and a latch member mounted on the drill string to project radially inwards therefrom, the latch member being received in the track recess in cam-following engagement with the track recess, the track recess being shaped such that longitudinal movement of the barrel cam relative to the latch member causes rotation of the barrel cam.

* * * * *